US011198228B2

(12) United States Patent
Ranieri et al.

(10) Patent No.: US 11,198,228 B2
(45) Date of Patent: Dec. 14, 2021

(54) KNIFE WITH INTEGRATED BLADE SNAPPER

(71) Applicant: Stanley Black & Decker, Inc., New Britain, CT (US)

(72) Inventors: Eric Ranieri, Pouiley les Vignes (FR); Antony Orsini, Cheshire, CT (US); Keith Lombardi, Avon, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 16 days.

(21) Appl. No.: 16/687,097

(22) Filed: Nov. 18, 2019

(65) Prior Publication Data

US 2021/0146557 A1 May 20, 2021

(51) Int. Cl.
*B26B 5/00* (2006.01)

(52) U.S. Cl.
CPC ..... *B26B 5/002* (2013.01); *B26B 5/003* (2013.01)

(58) Field of Classification Search
CPC ..... B26B 5/001; B26B 5/002; B26B 5/003
See application file for complete search history.

(56) References Cited

U.S. PATENT DOCUMENTS 2,736,963 A 3/1956 Seiter
2,870,537 A * 1/1959 Ortner ..... B26B 5/001 30/162
4,240,202 A * 12/1980 Gilbert ..... B26B 5/002 30/162
5,014,429 A 5/1991 McNamara
5,269,063 A * 12/1993 Okada ..... B26B 5/002 30/162
6,718,640 B1 4/2004 John
8,567,070 B2 10/2013 Rowlay et al.
8,727,195 B2 5/2014 Takashima
2005/0050734 A1 3/2005 Kesinger
2006/0185172 A1* 8/2006 Marshall ..... B26B 5/002 30/162
2009/0188115 A1* 7/2009 Deursen ..... B26B 5/002 30/162
2010/0088901 A1* 4/2010 Glancey ..... B26B 29/00 30/162
2012/0198703 A1* 8/2012 Ranieri ..... B26B 5/002 30/162

(Continued)

FOREIGN PATENT DOCUMENTS

CN 201002466 Y 1/2008
CN 104191435 A 12/2014

(Continued)

OTHER PUBLICATIONS

English translation of JP2005000574. (Year: 2005).*
English Translation of DE202005003900. (Year: 2005).*

*Primary Examiner* — Hwei-Siu C Payer
(74) *Attorney, Agent, or Firm* — Gabriel A. Haboubi

(57) ABSTRACT

A knife includes a body, and a blade slider slidably mounted within the body, the blade slider configured to hold and slidably move a blade relative to the body. The knife further includes a blade snapper pivotally coupled to the body, positioned such that when the blade slider selectively positions the blade to be engaged by the blade snapper, pivotal movement of the blade snapper imparts a force on a blade segment of the blade to detach the blade segment from the blade.

19 Claims, 22 Drawing Sheets

(56) References Cited

U.S. PATENT DOCUMENTS

| | | | | |
|---|---|---|---|---|
| 2020/0276722 | A1* | 9/2020 | Zhou | B26B 5/002 |
| 2021/0146557 | A1* | 5/2021 | Ranieri | B26B 5/002 |

FOREIGN PATENT DOCUMENTS

| | | | | |
|---|---|---|---|---|
| CN | 204354145 | U | | 5/2015 |
| DE | 202005003900 | U1 | | 6/2005 |
| DE | 102005038308 | A1 | | 10/2006 |
| EP | 400800 | A | * | 12/1990 |
| JP | S59214478 | A | | 12/1984 |
| JP | 2004305531 | A | | 11/2004 |
| JP | 2005000574 | A | | 1/2005 |
| JP | 2007252494 | A | | 10/2007 |
| KR | 20120139904 | A | | 12/2012 |
| KR | 20150044780 | A | | 4/2015 |

* cited by examiner

KNIFE WITH INTEGRATED BLADE SNAPPER

BACKGROUND OF THE INVENTION

1. Field of the Invention

This invention relates to utility knives that can selectively expose or protect a cutting edge of a snap-off replaceable blade which has segments that can be snapped off to expose a new cutting point or cutting surface.

2. Description of Related Art

A conventional snap-off blade utility knife includes a handle body with a blade holder slidably disposed within the handle such that a user may move the slider into a position of use where at least a forwardmost blade segment of a snap-off blade assembly may project through an opening at one end of the body, or may retract the blade assembly into the body so that the forwardmost blade segment (and the remainder of the blade assembly) is sheathed within the handle body. In some such snap-off blade utility knives, a user may need to provide a separate pair of pliers to break a blade segment off of the remainder of the snap-off blade. In other conventional knives, a mechanism for separating a blade segment from the snap-off blade may be provided with the knife. See, e.g., U.S. Pat. No. 8,567,070. As shown in such art, a blade snapper, if provided with the knife at all, may conventionally be removably locked to the body, and may be configured such that the blade snapper may be removed from the handle body, positioned appropriately relative to a forwardmost blade segment when such blade segment is extended from the body, such that the blade snapper may engage the blade segment and snap it off of the remainder of the snap-off blade assembly.

SUMMARY OF EMBODIMENTS OF THE INVENTION

According to an embodiment, a knife includes a body, and a blade slider slidably mounted within the body, the blade slider configured to hold and slidably move a blade relative to the body. The knife further includes a blade snapper pivotally coupled to the body, positioned such that when the blade slider selectively positions the blade to be engaged by the blade snapper, pivotal movement of the blade snapper imparts a force on a blade segment of the blade to detach the blade segment from the blade.

These and other aspects of various embodiments of the present invention, as well as the methods of operation and functions of the related elements of structure and the combination of parts and economies of manufacture, will become more apparent upon consideration of the following description with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only and are not intended as a definition of the limits of the invention, and that other scales and proportions are also contemplated and covered by this application. In addition, it should be appreciated that structural features shown or described in any one embodiment herein can be used in other embodiments as well. As used in the specification, the singular form of "a", "an", and "the" include plural referents unless the context clearly dictates otherwise.

BRIEF DESCRIPTION OF THE DRAWINGS

For a better understanding of embodiments of the present invention as well as other objects and further features thereof, reference is made to the following description which is to be used in conjunction with the accompanying drawings, where.

DETAILED DESCRIPTION OF EXEMPLARY EMBODIMENTS OF THE INVENTION

Figure 1:
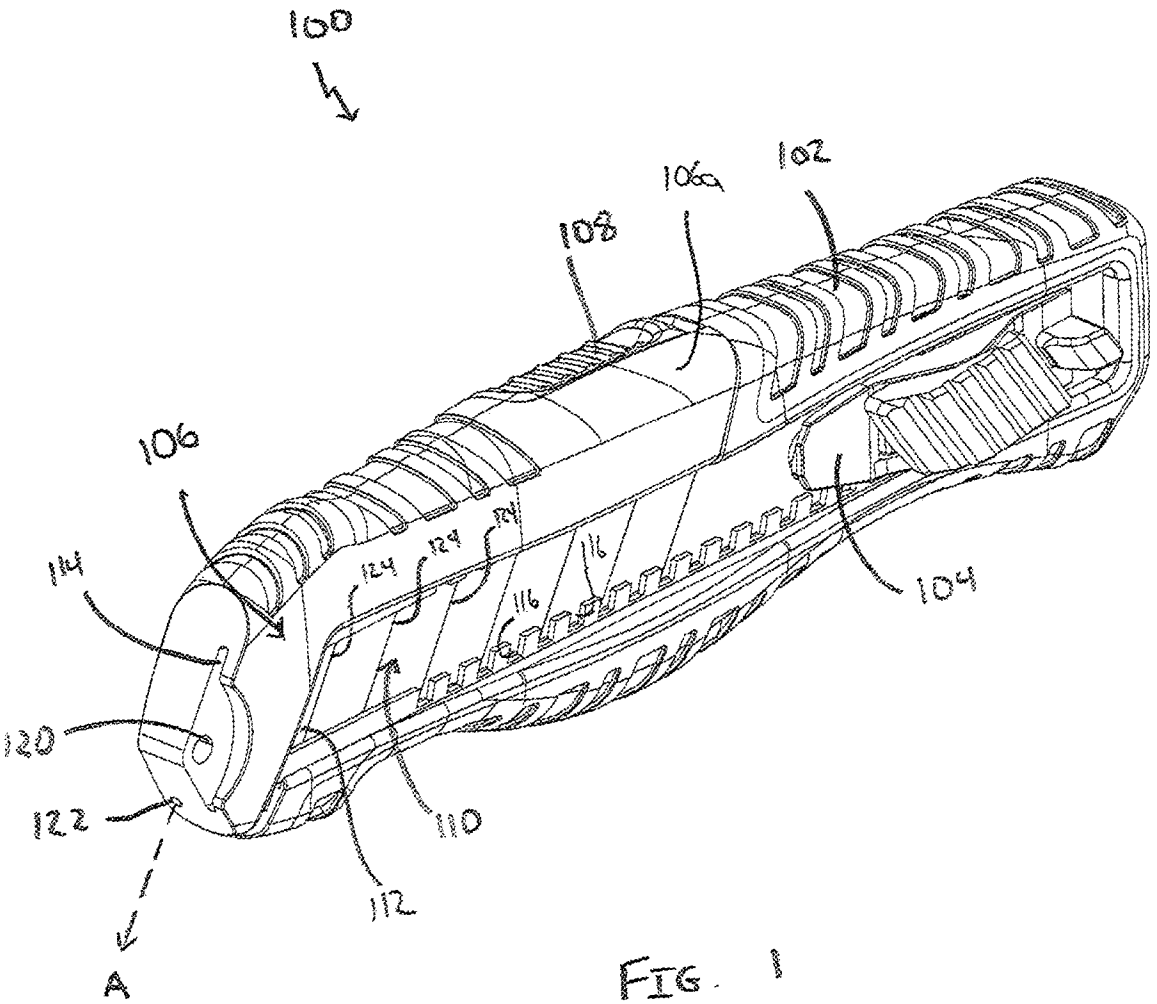
FIG. 1 is a perspective view of a rear, left side of a snap-off blade utility knife according to an embodiment of the present invention, with an integrated blade snapper in a closed position.
Figure 2:
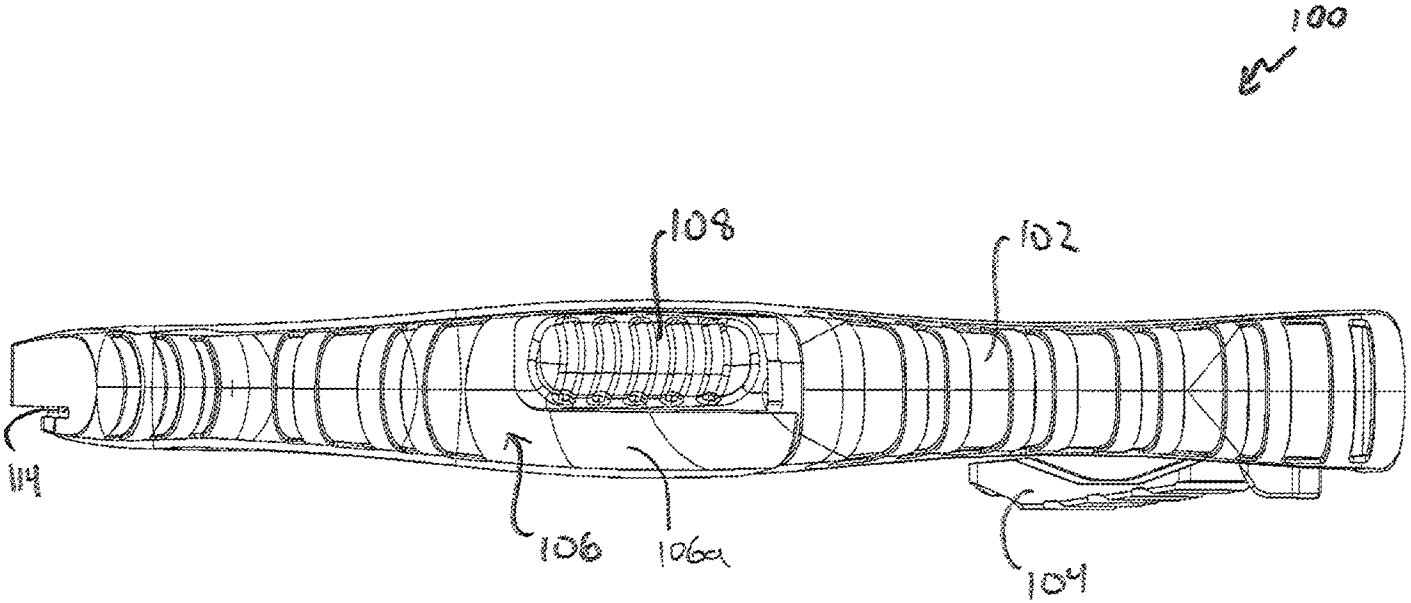
FIG. 2 is a top view of the utility knife of FIG. 1, with the integrated blade snapper in the closed position.
Figure 3:
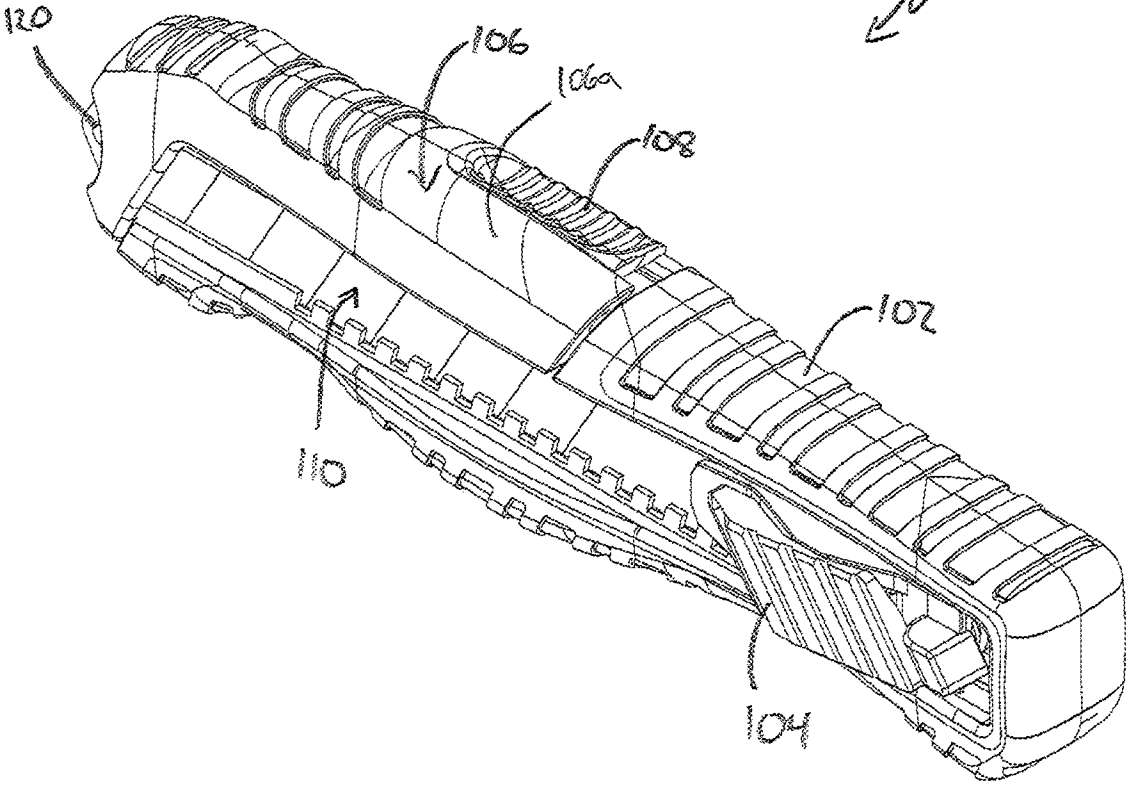
FIG. 3 is a rear, left side perspective view of the utility knife of FIG. 1, with the integrated blade snapper in the closed position.
Figure 4:
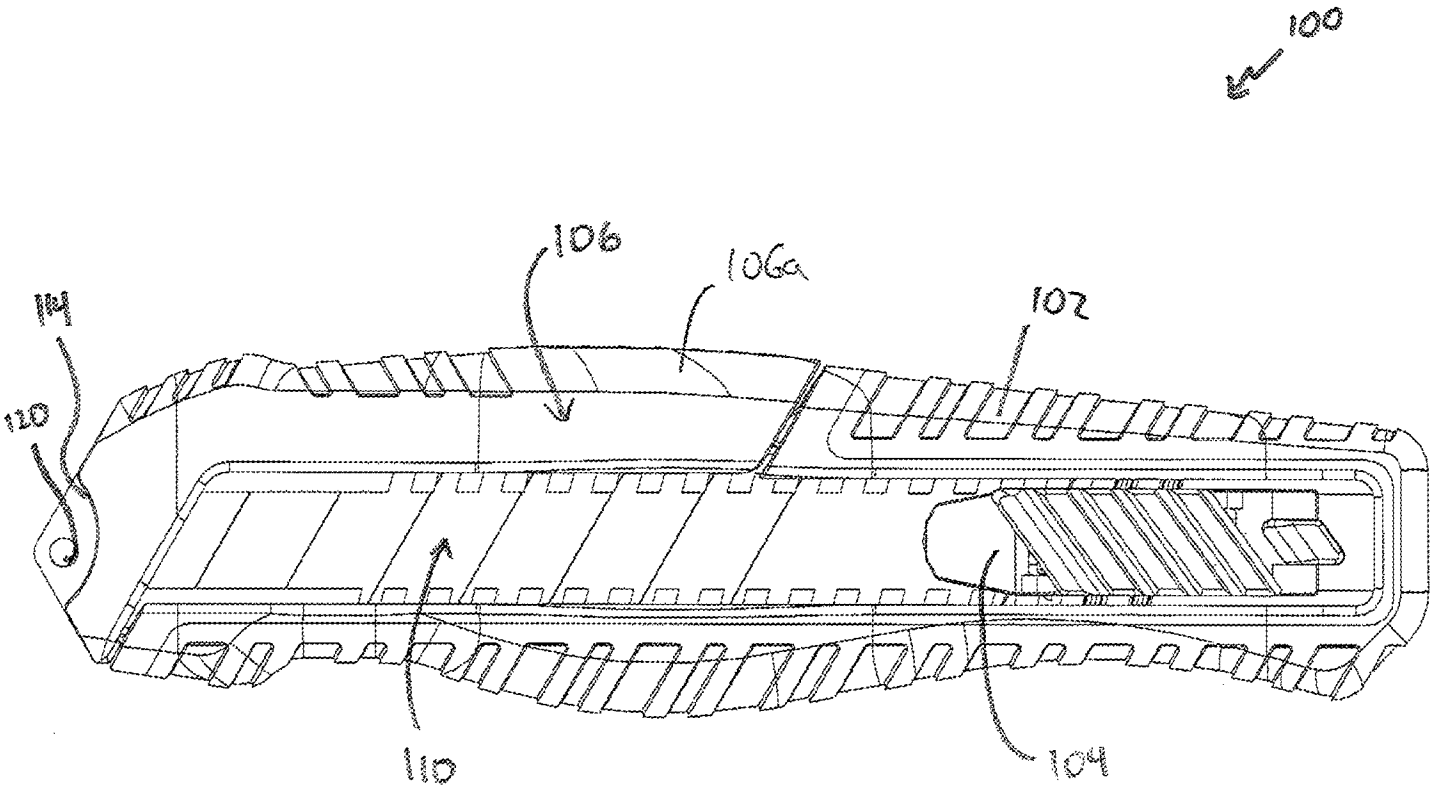
FIG. 4 is a left side view of the utility knife of FIG. 1, with the integrated blade snapper in the closed position.

FIGS. 1-8 show a knife 100 in accordance with an embodiment of the present invention. As shown in FIG. 1, for example, the knife 100 includes a body 102, a blade slider 104, a blade snapper 106, and a blade snapper latch 108. The retractable blade slider 104 is constructed and arranged to be able to position a multi-blade blade assembly 110 at a position of use wherein at least a portion of a forwardmost blade segment 112 projects through an opening 114 at a forward end of the blade snapper 106 as mounted to the body 102, and to retract the blade assembly 110 into the body 102 so that no blades are exposed outside the body 102.

The blade snapper 106 is movably coupled to the body 102 in a way that breaks a plane defined by the path of the blade slider 104 or the blade assembly 110, by moving the opening 114. FIGS. 1-4 show the knife 100 with the blade snapper 106 in a closed position, such that the blade slider 104 may move the blade assembly 110 through the opening 114 to extend or retract the blade assembly 110 (and in particular at least the forwardmost blade segment 112 thereof) into or out of the body 102. As described below, in some embodiments the body 102 may include increment notches 116 which may be engaged by the blade slider 14 so that the blade assembly 110 may be held in defined positions of extension relative to the body 102 through actuation of the blade slider 104 (e.g., pressing the blade slider 104 so that the blade slider 104 disengages from the increment notches 116, permitting sliding the blade slider 104 forward or backward until the blade slider 104 is released to reengage with a defined ones of the increment notches 116.

As described in greater detail below, the blade snapper 106 may be coupled to the body 102, and is constructed and arranged to selectively snap-off a blade segment (e.g., the forwardmost blade segment 112) from the remainder of a blade assembly 110 while the blade snapper 106 remains attached to the body 102. In some embodiments, such as that illustrated, the blade snapper 106 may be hingedly or otherwise pivotally coupled to the body 102, providing a lever arm which when actuated applies a force to the blade segment 112 that is not applied to the remainder of the blade assembly 110, so as to break the blade segment 112 away from the remainder of the blade assembly 110. In some embodiments, multiple blades segments may be snapped-off by repeating the snap-off operation multiple times, or by extending multiple blade segments through the opening 114 prior to engaging in the snap-off operation. The blade snapper latch 108 is constructed and arranged to move between a latched position and an unlatched position, wherein the movement of the blade snapper latch 108 to the unlatched position permits relative movement between the blade snapper 106 and the body 102.

As discussed in greater detail below, and as seen in FIG. 1, the blade snapper 106 may include a magnet 120, which may hold a snapped-off blade segment when such blade segment is separated from the blade assembly 110. As further discussed below, but as indicated on FIG. 1, the blade snapper 106 may be pivotally coupled to the body 102 at a pivot pin 122 extending along a pivot axis A.

In various embodiments, the blade assembly 110 may be in the form of an elongated flat, thin strip which is sharpened along a lower edge, with the point of the blade being formed by the intersection of the lower edge and an inclined front edge. In one embodiment, the blade assembly 110 is made of steel material. In some embodiments, the blade assembly 110 may be formed from a metal material which may magnetically attract to or be attracted by the magnet 120. The blade assembly 110 may be formed with a series of score lines 124 parallel to the front edge so that when a sharp new edge is required, this can be obtained by snapping off the forward blade segment 112 of the blade assembly 110 at the leading score line 124. In one embodiment, as discussed in greater detail below, the blade snapper 106 can be used to snap-off one or more blade segments from the blade assembly 110.

FIGS. 5-8 illustrate the knife 100 with the blade snapper 106 in an open position, pivoted about the axis A. It may be appreciated that were the blade slider 104 extended such that the forwardmost blade segment 112 (or a subsequent blade segment) was positioned within the opening 114 when the blade snapper 106 was pivoted, the force of the pivoting of the blade snapper 106 would press against the blade segment relative to the remainder of the blade assembly 110 and subsequently break the blade segment away from the remainder of the blade assembly 110. It may also be appreciated that the detached blade segment or segments separated from the blade assembly 110 may be held onto the blade snapper 106 through the magnet 120 in embodiments comprising such a magnet. Other holding mechanisms within or otherwise associated with the blade snapper 106 are also possible, including but not limited to a spring (e.g., a leaf spring) which may clamp the detached blade segment (s) to the blade snapper 106. It may be appreciated that in various embodiments, the length of each blade segment and the amount by which the blade slider 104 advances incrementally (e.g. through engagement between the blade slider 104 and the increment notches 116 in the body 102) may be configured to correspond to each other so that a desired region of a blade segment may be held in the opening 114, and so that a desired contact engagement between the blade snapper 106 and the blade segment may occur when the blade snapper 106 is pivoted about the axis A.

Figure 5:
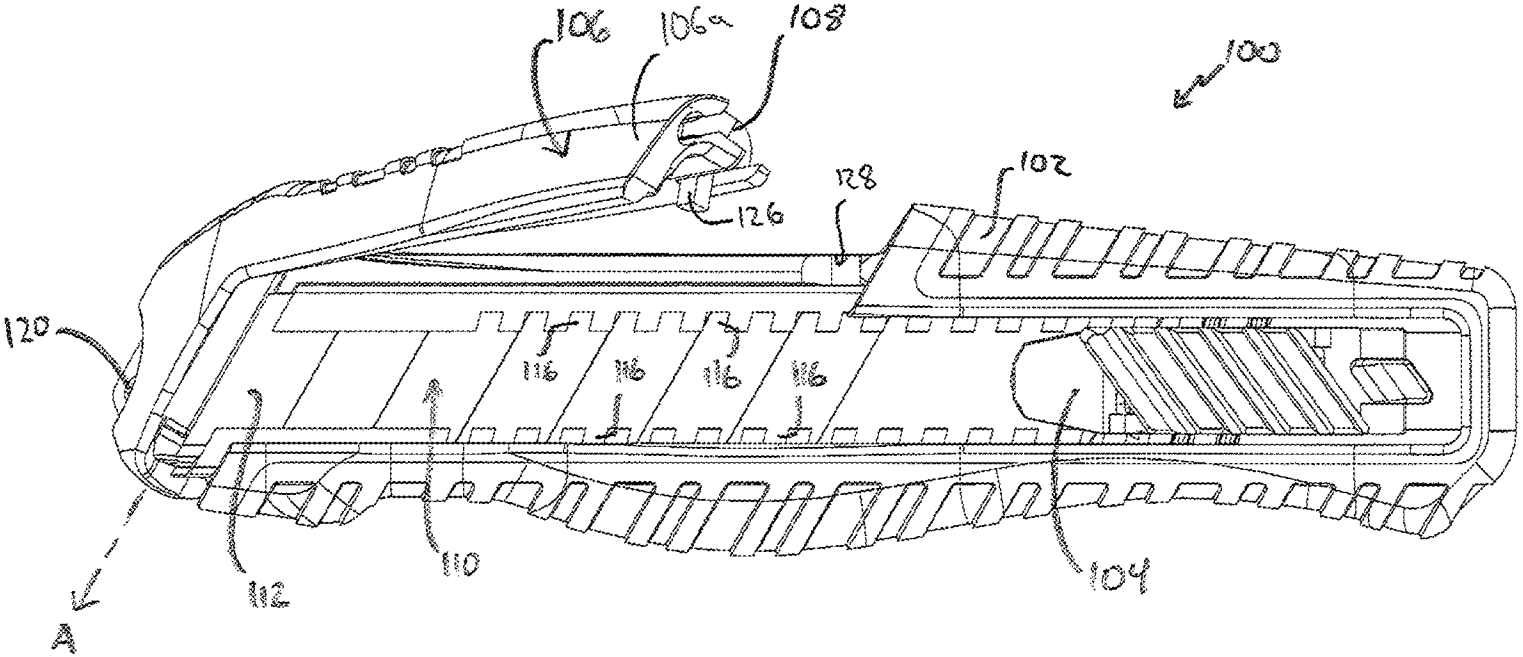
FIG. 5 is a left side view of the utility knife of FIG. 1, as depicted in FIG. 4, with the integrated blade snapper in an open position.
Figure 6:
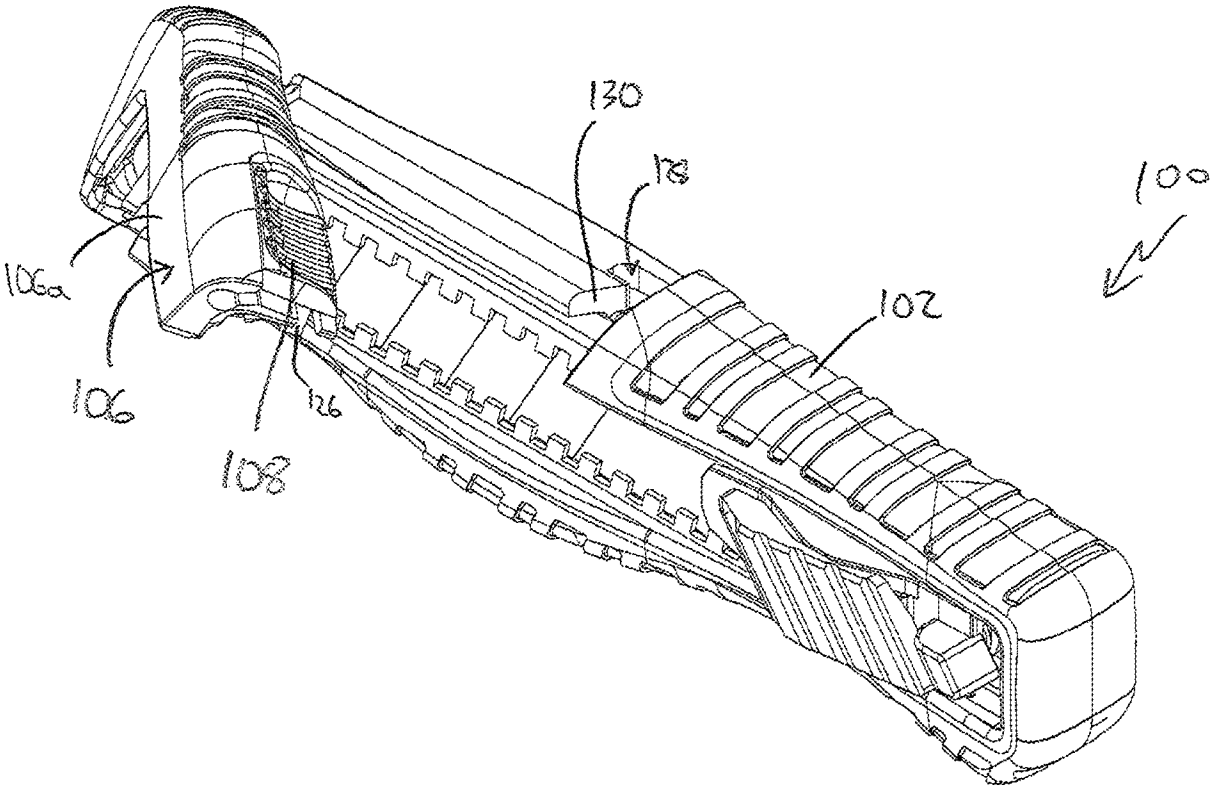
FIG. 6 is a rear, left side perspective view of the utility knife of FIG. 1, as depicted in FIG. 3, with the integrated blade snapper in the open position.
Figure 7:
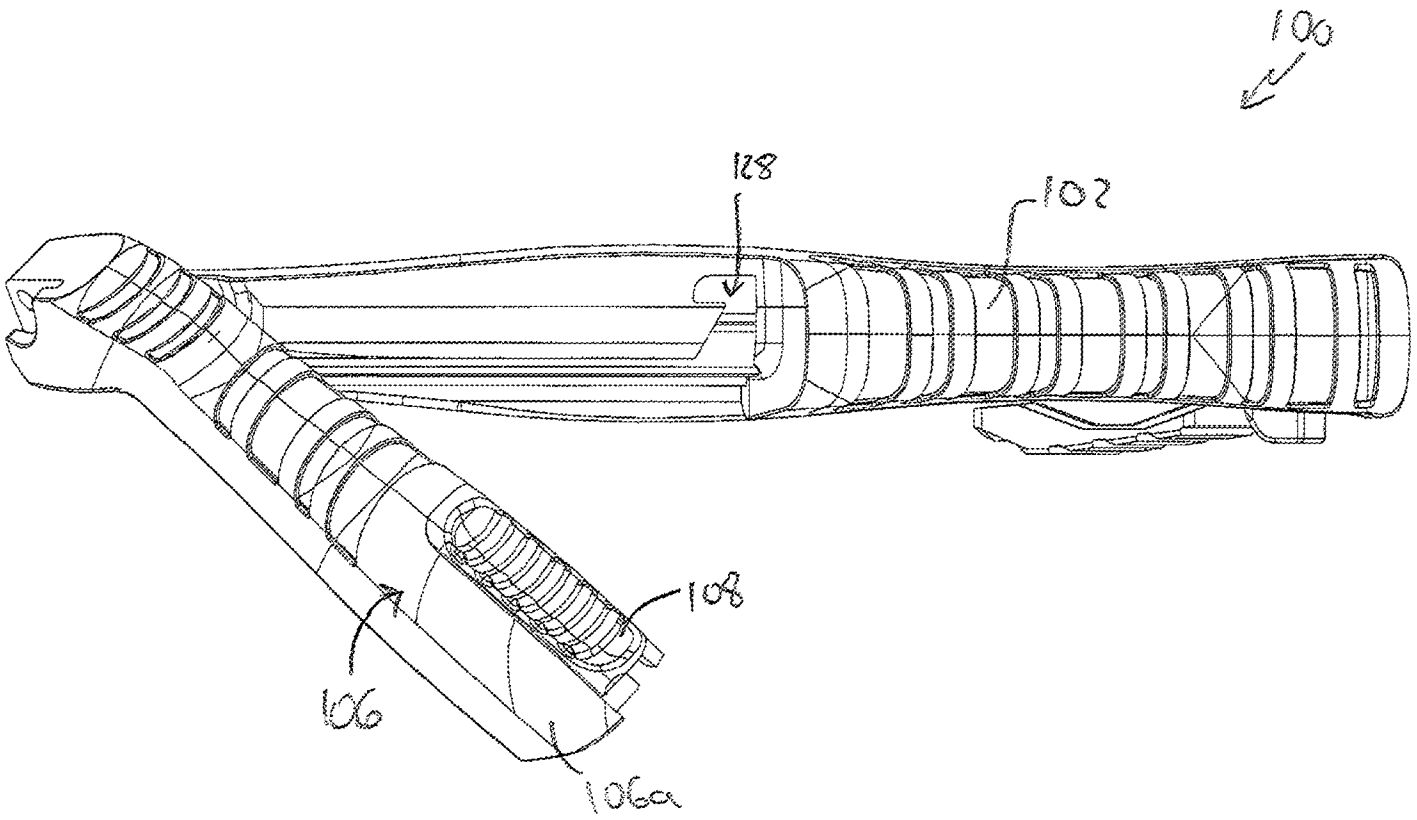
FIG. 7 is a top view of the utility knife of FIG. 1, as depicted in FIG. 2, with the integrated blade snapper in the open position.
Figure 8:
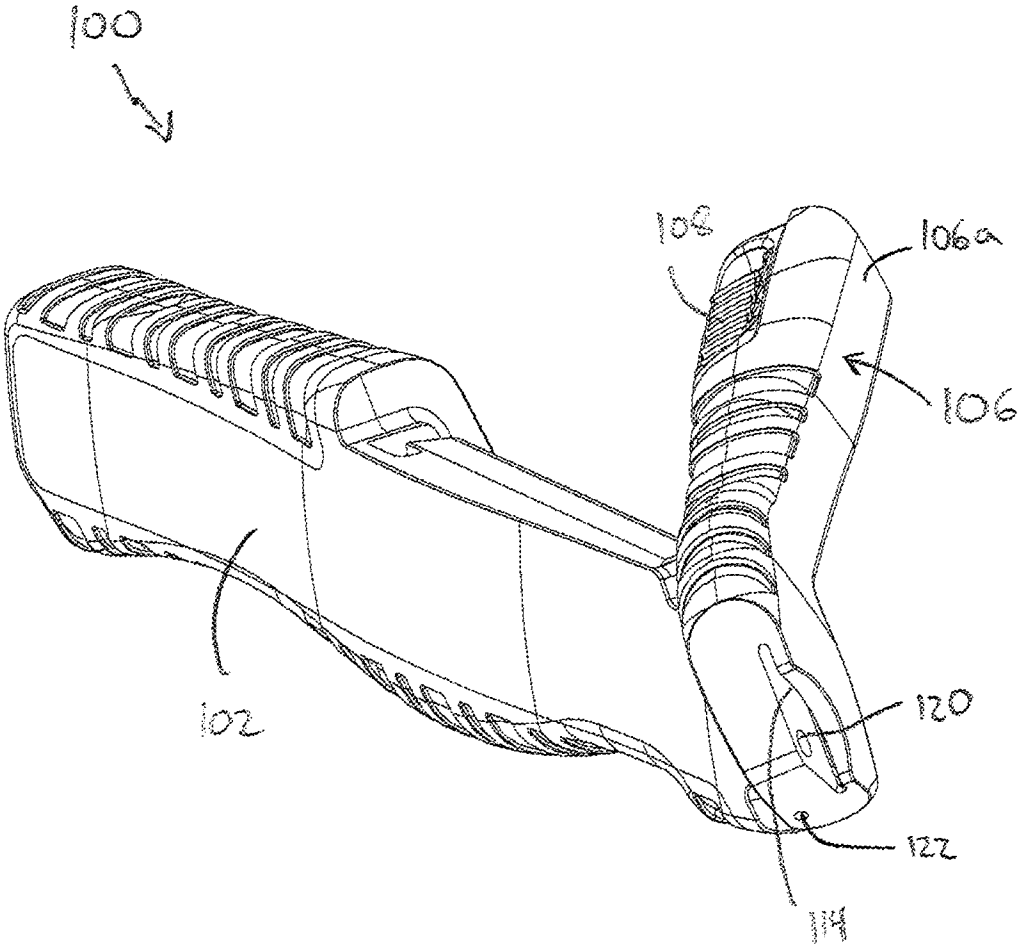
FIG. 8 is a perspective view of a front, right side of the utility knife of FIG. 1, with the integrated blade snapper in the open position.

It may be appreciated that the latch 108 may selectively hold the blade snapper 106 in a fixed position to the body 102 (and when secured would hold the opening 114 of the blade snapper 106 aligned with the path of travel for the blade slider 104 or the blade assembly 110). In some embodiments, the fixed position may be such that the blade snapper 106 (e.g., at least a lever arm 106*a* thereof) is flush with or recessed into the body 102. Further shown in FIGS. 5-8 is a latch protrusion 126 mounted to the blade snapper latch 108. In some embodiments, a spring (obscured) may bias the latch 108 into a latched position, such as one where the latch protrusion 126 is biased towards the opening 114 on the blade snapper 106, however the latch 108 may be pulled away from the opening 114, thus moving the latch protrusion 126 away from the opening 114. As shown in FIG. 5, however seen more clearly in the views of FIG. 6 and FIG. 7, in some embodiments the latch protrusion 126 may be selectively received by a protrusion receptacle 128 in the body 102. The protrusion receptacle 128 may be shaped such that when the latch 108 is in the latched position (e.g., with the latch protrusion 126 closer to the opening 114), the protrusion 126 may move into a position partially and operatively surrounded by walls of the receptacle 128, preventing the blade snapper 106 from pivoting about the axis A. When the latch 108 is moved to an unlatched position (e.g., with the latch protrusion 126 moved away from the opening 114), the protrusion 126 may be moved with the latch 108 so that the protrusion 126 may exit the receptacle 128 as the blade snapper 106 is pivoted about the axis A to snap a blade segment from the blade assembly 110. In some embodiments, such as when the latch 108 is spring biased in to the latched position, an entry wall 130 of the receptacle 128 may be angled so that movement of the blade snapper 106 from the open position of FIGS. 5-8 to the closed position of FIGS. 1-4 may cause the protrusion 126 to ride along the entry wall 130, pushing the protrusion 126 and thus the latch 108 from the latched position to the unlatched position through entry into the receptacle 128. Once the protrusion 126 has entered into the receptacle 128 past the entry wall 130, the latch 108 may return to the latched position (e.g., under the spring bias of a spring associated with the latch 108).

It may be appreciated that other latch mechanisms similar to latch 108 may be utilized in various embodiments, where such latch mechanisms are provided at all. For example, in some embodiments the pivot pin 122 or other mechanism configured to permit movement of the blade snapper 106 relative to the body 102 to move the opening 114 through which the blades of blade assembly 110 normally passes may be implemented in the knife 100. For example, in some embodiments the pivot pin 122 or other such mechanism may have its own implemented resistance, so that movement of the blade snapper 106 requires user force to overcome friction or other imported resistance to move the blade snapper 106 from the closed position to the open position. As an example, in some embodiments the blade snapper 106 may be spring biased into the closed position, and as such a user wishing to snap off a blade segment would need to overcome the force of the spring bias to move the blade snapper 106 relative to the body 102.

While the knife 100 disclosed above may utilize conventional snap blades that have a tang that couples to the slider, and a plurality of blades extending therefrom such that as a forwardmost-blade is utilized it can be snapped off and discarded to expose a new point, it may be appreciated that the teachings of the blade snapper 106 disclosed above may be incorporated other styles of knives. For example, a four-point utility blade such as those disclosed in U.S. Pat. No. 8,161,654, incorporated herein by reference in its entirety, includes a generally trapezoidal and generally symmetrical configuration having one or more mounting notches so as to be engaged by conventional utility knives, where the blade has a main body with the one or more mounting notches formed in a first linear edge and a cutting edge opposite the first linear edge, and the cutting edge being disposed on a longest edge of the trapezoid, where the blade has one or more detachable blade segments mounted to the main body. As discussed below, in some embodiments a utility knife configured to receive conventional trapezoidal utility knife blades may include a blade snapper configured to permit snapping of four-point utility knife blades similar to those disclosed in the U.S. Pat. No. 8,161,654.

As such, FIG. 9-FIG. 18 show a knife 200 in accordance with another embodiment of the present invention. As shown, in an embodiment the knife 200 includes a body 202, a blade slider 204, a blade snapper 206 (having a lever arm 206*a*), and a blade snapper latch 208. The retractable blade slider 204 is constructed and arranged to be able to position either a conventional trapezoidal utility knife blade, or, as illustrated, a four-point utility knife blade 210 at a position of use wherein at least a portion of a detachable blade segment 212 (separable from a main body 210*a* of the blade 210) projects through an opening 214 at a forward end of the blade snapper 206 as mounted to the body 202, and to retract the blade 210 into the body 202 so that no part of the blade 210 (including detachable blade segment 212) is exposed outside the body 202.

Figure 9:
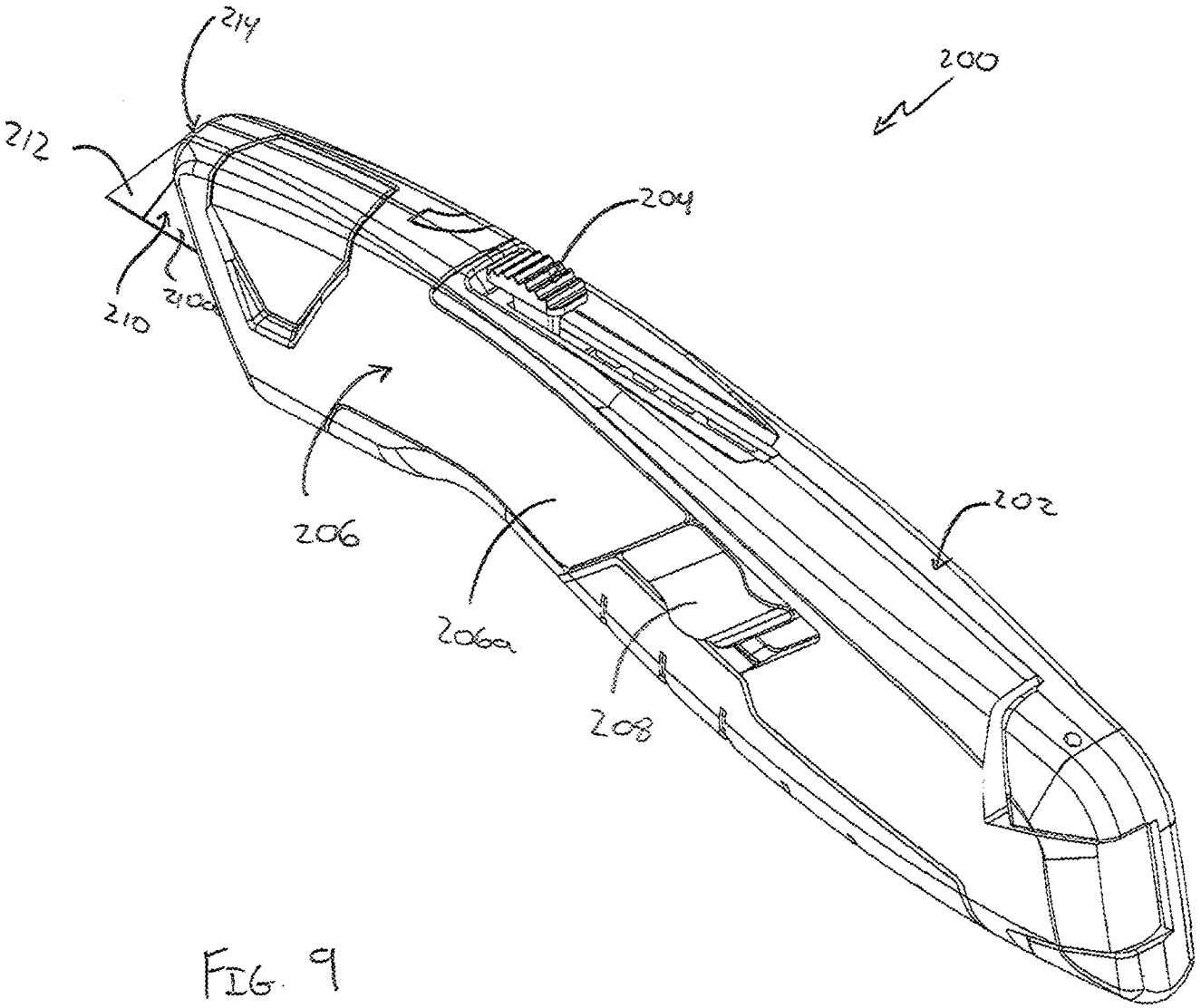
FIG. 9 is a perspective view of a rear left side of a utility knife configured to receive a four-point snappable utility knife blade, with the blade unsnapped and in an extended position for use.
Figure 10:
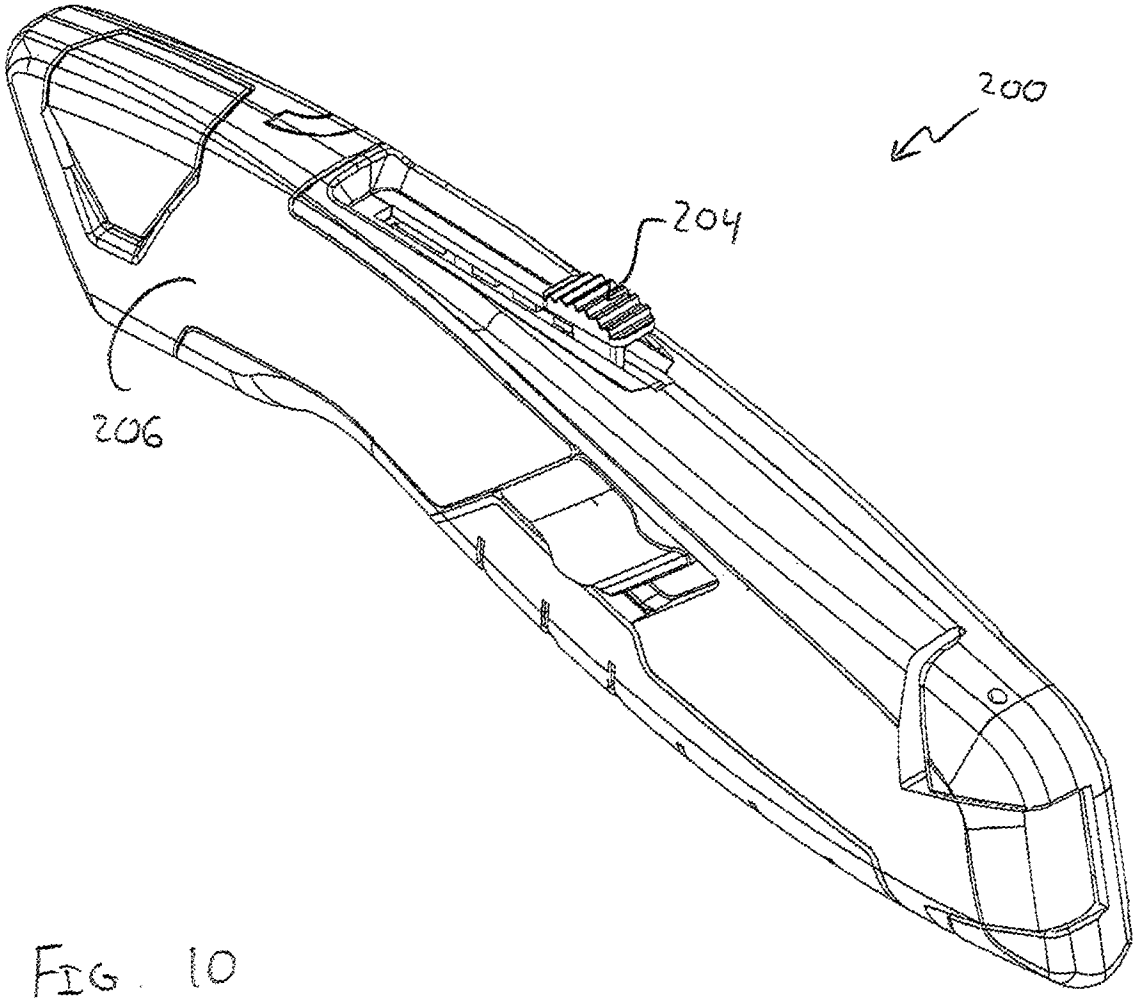
FIG. 10 is a perspective view of the rear left side of the utility knife of FIG. 9, with the blade in a retracted position for utilizing an integrated blade snapper to snap the blade.

While the blade slider 204 is positioned in FIG. 9 to place the blade 210 into an extended position protruding from the body 202 for use in a cutting operation, FIG. 10 shows the blade slider 204 in a retracted position, such that the blade 210 is positioned so that the blade snapper 206 may snap the blade 210, to detach the blade segment 212 from the main body 210*a* of the blade 210. In an embodiment the position of the blade slider 204 that facilitates snapping the blade 210 using the blade snapper 206 may be forward of a fully retracted position of the blade slider 204, so as to deter unintentional snapping of the blade 210 when the blade 210 is retracted for storage.

Figure 11:
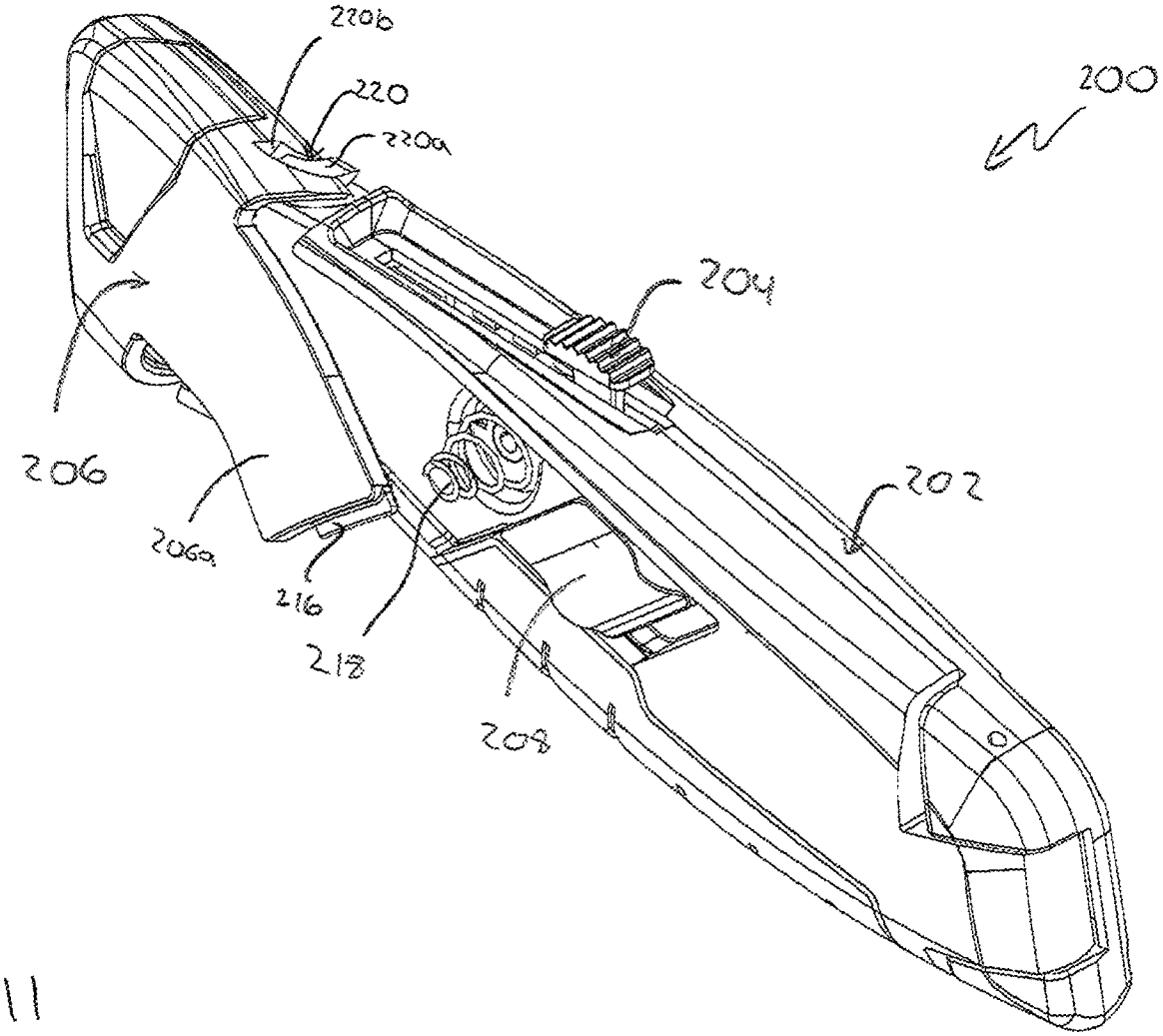
FIG. 11 is a perspective view of the rear left side of the utility knife of FIG. 9, with the blade in a retracted position for utilizing the integrated blade snapper to snap the blade, and with the blade snapper moved into a position to begin to snap the blade.

As shown in FIG. 11, in an embodiment a snapping operation may be conducted when the blade slider 204 is appropriately positioned as was shown in FIG. 10, and as discussed in greater detail below. Specifically, snapping the blade 210 may comprise actuating the blade snapper latch 208 so as to release the blade snapper 206 from being held in a fixed position against the body 202 that normally aligns the opening 214 with the path of movement for the blade 210 as normally advanced or retracted by the blade slider 204. In some embodiments, the fixed position may be such that the blade snapper 206 (e.g., at least a lever arm 206*a* thereof) is flush with or recessed into the body 202. It may be appreciated that in some embodiments the blade snapper latch 208 may be configured to slide relative to the body 202 so as to selectively hold (e.g., partially surround) a protrusion 216 on or extending from the blade snapper 206 to prevent movement of the blade snapper 206 relative to the body 202. In some embodiments the blade snapper latch 208 may be spring biased into the holding position such that it would surround the protrusion 216 when the blade snapper 206 is positioned against the body 202 until a user actuates the latch 208 by pulling the latch away from the protrusion 216 against the force of the spring bias. As shown in the illustrated embodiment, a spring 218 may be positioned between the body 202 and the blade snapper 206 (e.g., mounted to the body 202 in the illustrated embodiment, or mounted to the blade snapper 206 in other embodiments), so that when the blade snapper 206 is released from the body through actuation of the latch 208, the spring 218 may push the blade snapper 206 away from the body 202. In an embodiment, the force of the spring may be small enough such that it does not cause the blade snapper 206 to separate the segment 212 from the main body 210*a* of the blade 210, while in other embodiments, the force of the spring 218 or other associated mechanism may be sufficient to detach the segment 212. In some embodiments, the separation may just be sufficient to create a user engageable surface so that a user may position their fingernails or fingertips between the lever arm 206*a* and the body 202 to permit desired movement of the blade snapper 206.

Further shown in FIG. 11, and as discussed in greater detail below, is that in some embodiments an interlock feature 220 may be provided between the blade snapper 206 and the body 202, where an arced body 220*a* may be selectively received in an arced recess 220*b* through pivotal motion of the blade snapper 206. It may be appreciated that in some embodiments the arced body 220*a* may be formed on the body 202 while the arced recess 220*b* may be formed on the blade snapper 206, while in other embodiments the arrangement may be inverted such that the arced body 220*a* is formed on the blade snapper 206 while the arced recess 220*b* is formed on the body 202. It may further be appreciated that the shape of the corresponding arcs of the body 220*a* and the recess 220*b* may be shaped to follow the movement of the blade snapper 206 as it rotates about an axis of rotation as discussed in greater detail below, which might extend at different angles across varying embodiments.

Figure 12:
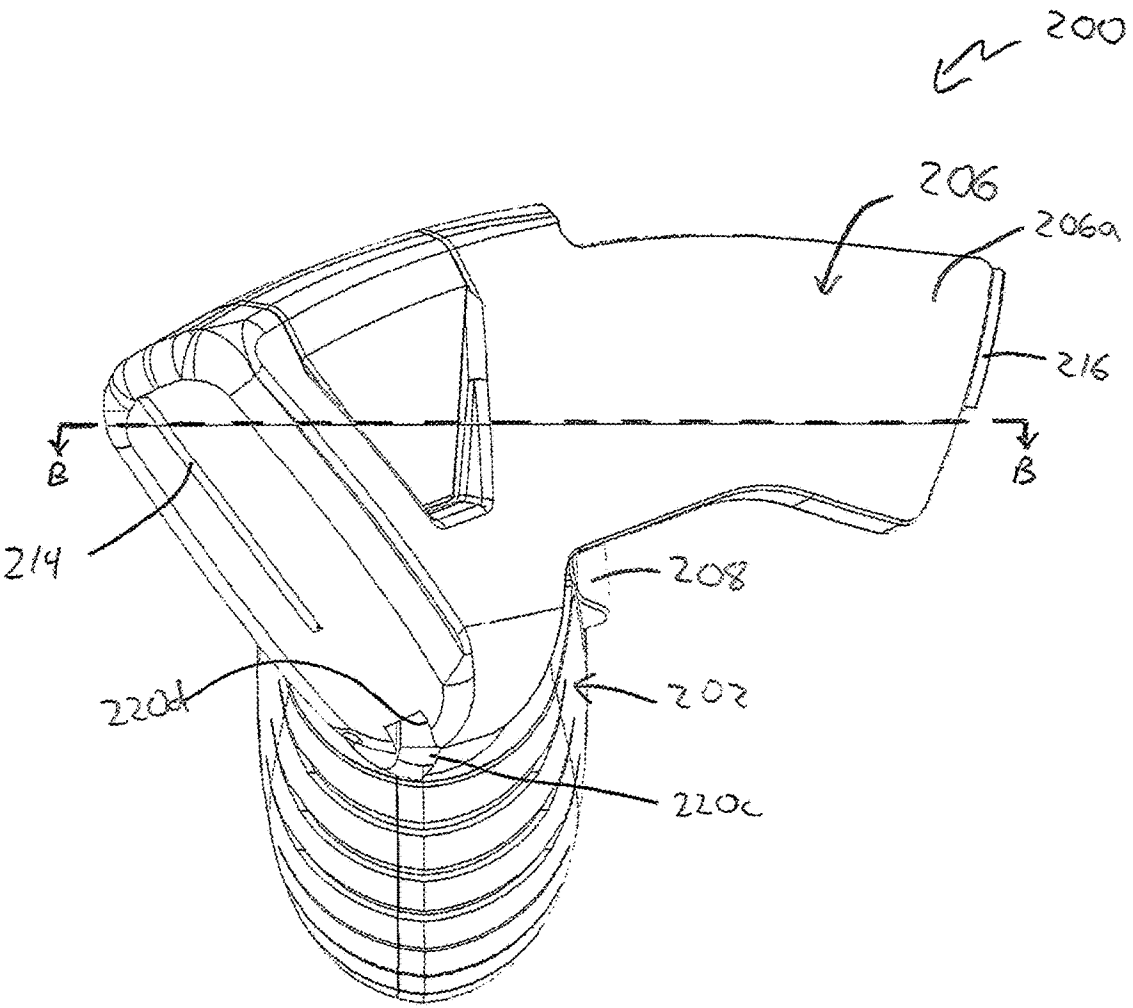
FIG. 12 is a front view of the utility knife of FIG. 9, with the blade in a retracted position for utilizing the integrated blade snapper to snap the blade, and with the blade snapper moved into a position such that the blade has just snapped to detach a separable portion of the blade from the remainder of the blade.
Figure 13:
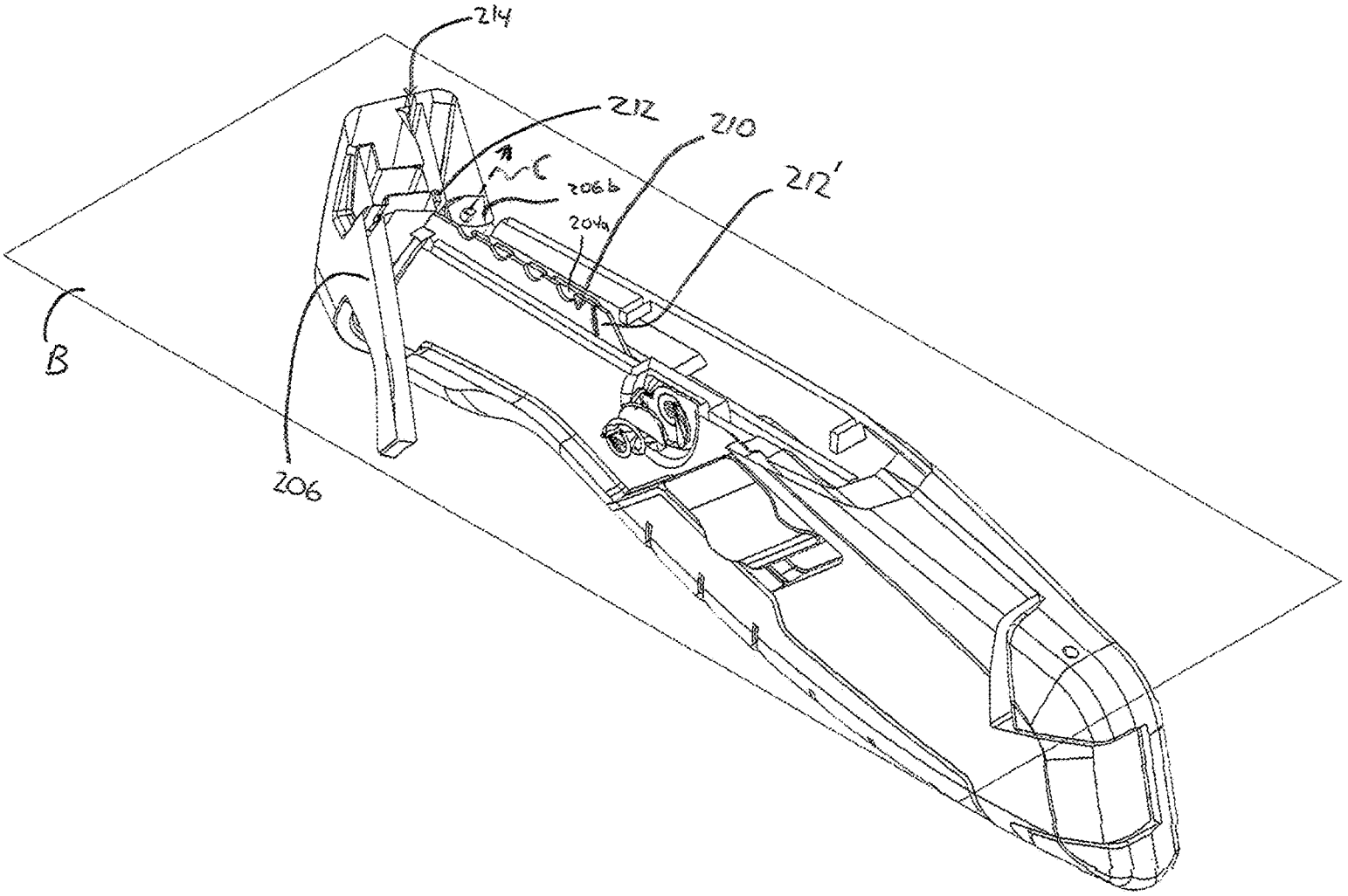
FIG. 13 is a sectioned perspective view of the rear left side of the utility knife of FIG. 9, along a plane illustrated in FIG. 12, showing an internal mechanism of the blade snapper.
Figure 14:
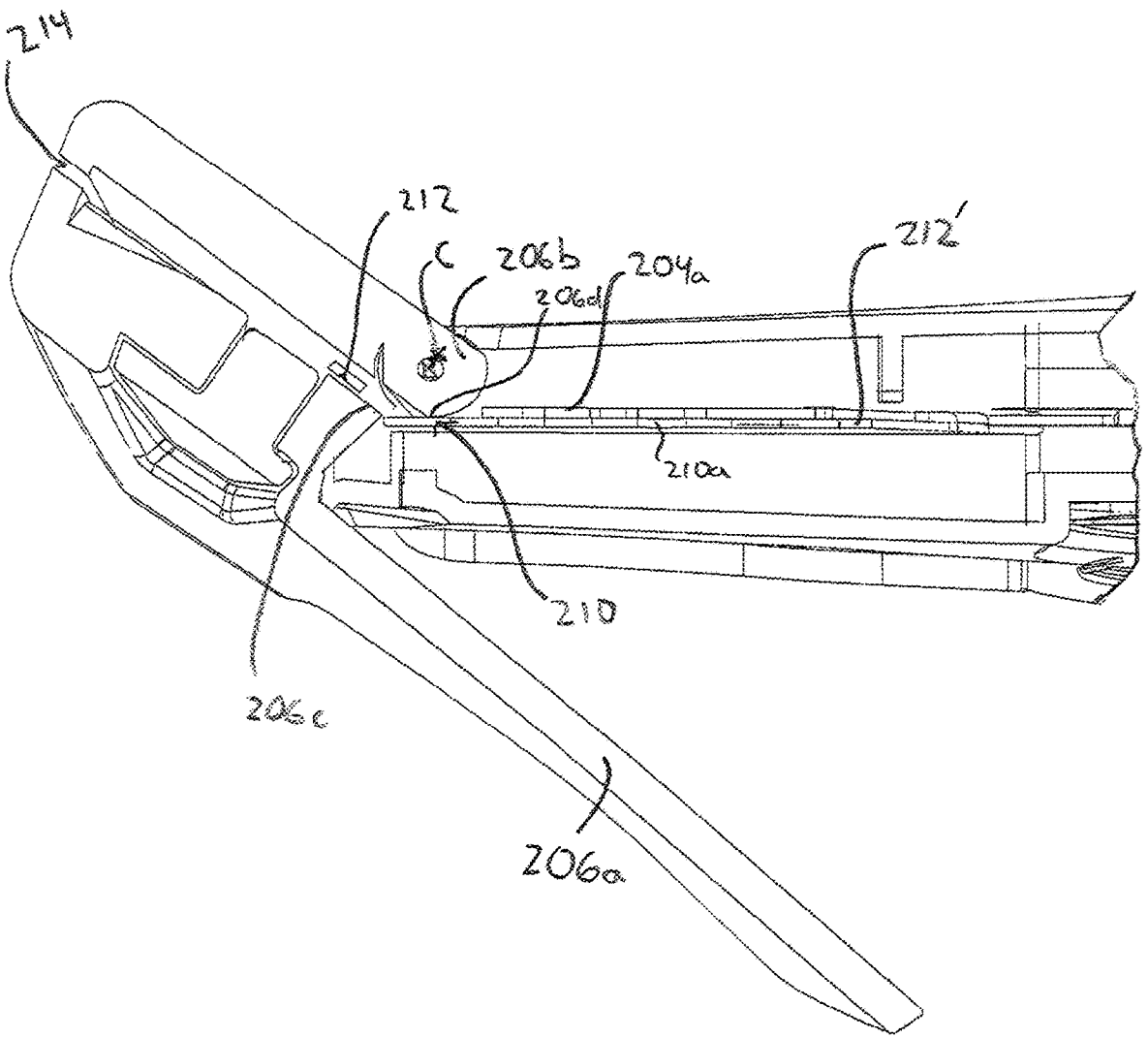
FIG. 14 is a sectioned top view of the utility knife of FIG. 9, into the plane illustrated in FIG. 12, further showing the internal mechanism of the blade snapper.

FIGS. 12-14 show various views and sections of the utility knife 200 during a snapping operation. It may be appreciated that like in FIG. 11, the blade 210 would be in a retracted position for utilizing the integrated blade snapper 206 to detach the blade segment 212, however as shown in FIGS. 12-14, the blade snapper 206 is moved into a position such that the blade 210 has just snapped, and thus the segment 212 has just detached from the main body 210*a* of the blade 210. As shown in the front view of FIG. 12, the opening 214 has moved with the blade snapper 206 so as to no longer be in alignment with the extension of the body 202 (and in particular, the path which the blade 210 normally extends or retracts along when moved by the blade slider 204). Additionally shown in FIG. 12 is that in some embodiments the interlock feature 220 may further comprise a second arced body 220*c*, formed to selectively engage with a second arced recess 220*d*, such that the interlock feature 220 is provided on additional regions of the body 202 and the blade snapper 206. Further shown in FIG. 12 is a section line defining a plane B, seen more clearly in the perspective view of FIG. 13 and the enlarged top view of FIG. 14, that shows how internal features of the blade snapper 206 acts on the blade 210.

As shown in FIGS. 13 and 14, for example, in rotation of the blade snapper 206, (e.g., through manual engagement of the lever arm 206*a* thereof) about an axis of rotation C defined at a hinge 206*b*, a segment engaging region 206*c* of the blade snapper 206 may engage the blade segment 212 in a manner that applies pressure to the segment 212 disproportionate to forces applied to the remainder of the blade 210, such as the main body 210*a*. In some embodiments, the main body 210*a* of the blade 210 may be held fixed by the blade slider 204 (e.g. a blade carriage 204*a* thereof slidably movable by a button extending from the housing). In various embodiments, such as that illustrated, rotation of the blade snapper 206 may cause a portion 206*d* of the hinge 206*b* (which may be appropriately radiused) to take up a gap behind the blade 210 adjacent to the blade segment 212 (e.g., such gap being approximately the same as the width of the blade carriage 204*a* of the blade slider 204), so as to support or provide an opposing force to the blade 210 relative to the force being applied by the segment engaging region 206*c* to the segment 212. It may be appreciated that the score line or other structural weakness between the blade segment 212 and the remainder of the blade 210 would cause these disparate or opposing forces to cause the blade segment 212 to separate from the main body 210*a* along the score line. It may be appreciated that in some embodiments the segment engaging region 206*c* may be sized or shaped to be substantially the size and/or shape of the segment 212, while in other embodiments the segment engaging region 206*c* may be smaller, yet appropriately positioned to apply the desired force to snap the segment 212 off of the blade 210.

Figure 15:
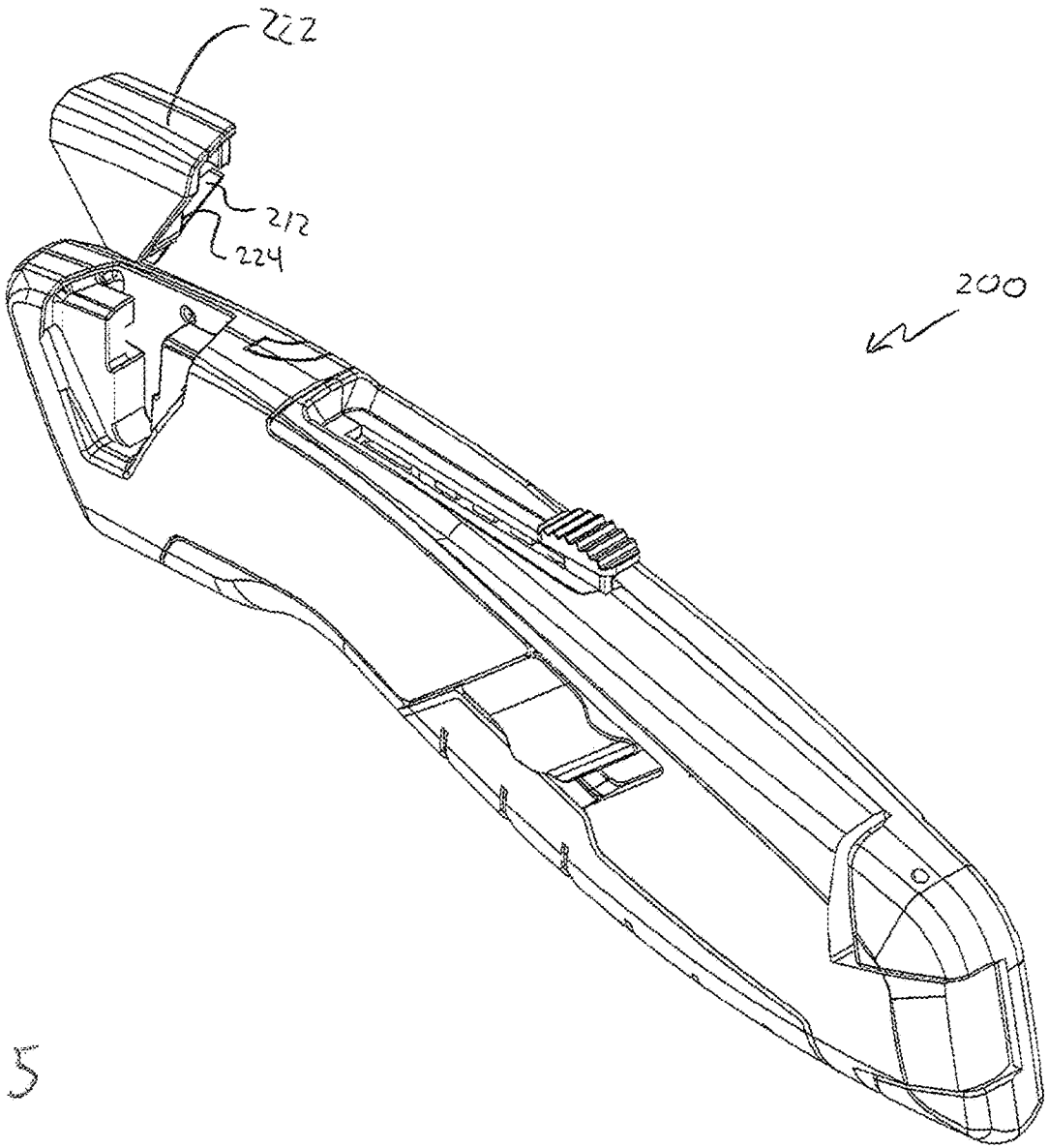
FIG. 15 is a perspective view of the rear left side of the utility knife of FIG. 9, following a blade snapping operation, with a separable portion removal mechanism lifting a detached separable portion of the blade away from the knife.

As shown in FIG. 15, in some embodiments a blade segment removal tool 222 may be provided on the knife 200. In an embodiment the segment removal tool 222 may include a magnet or other segment holding feature 224 which might hold a separated segment 212 when the segment 212 is separated from the main body 210*a*, such that when the segment removal tool 222 is utilized, the detached segment 212 will move with the segment removal tool 222 into a position easily removed by a user. In some embodiments, such as that illustrated, utilizing the segment removal tool 222 may comprise lifting the segment removal tool away from the blade snapper 206. In other embodiments, using the segment removal tool 222 may comprise rotating the tool 222 away from the blade snapper 206 (e.g., through a hinged connection therebetween).

Figure 16:
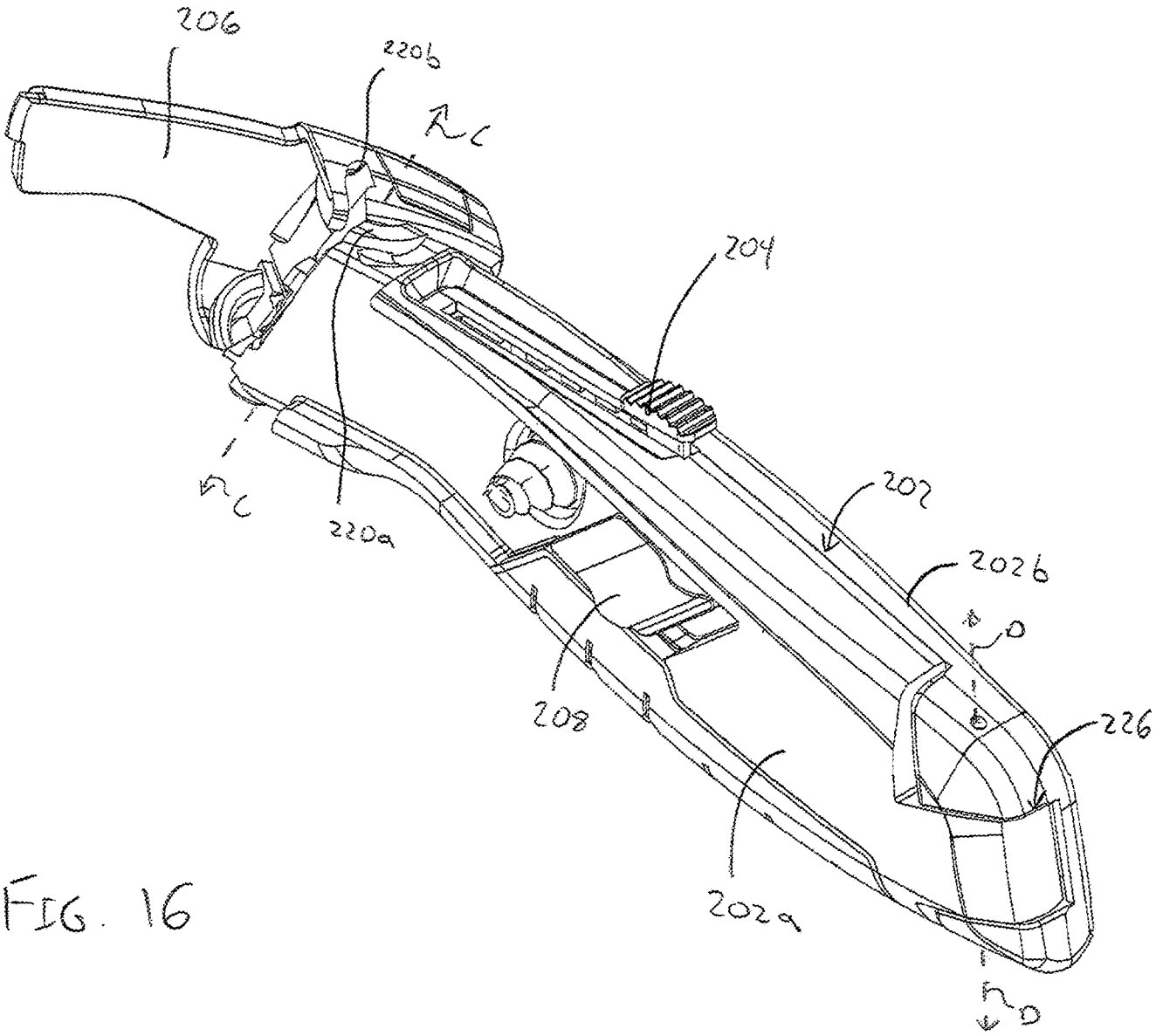
FIG. 16 is a perspective view of the rear left side of the utility knife of FIG. 9, with the blade in a retracted position for storage, and the blade snapper mechanism in an opened position facilitating opening of the knife for a blade change operation.
Figure 17:
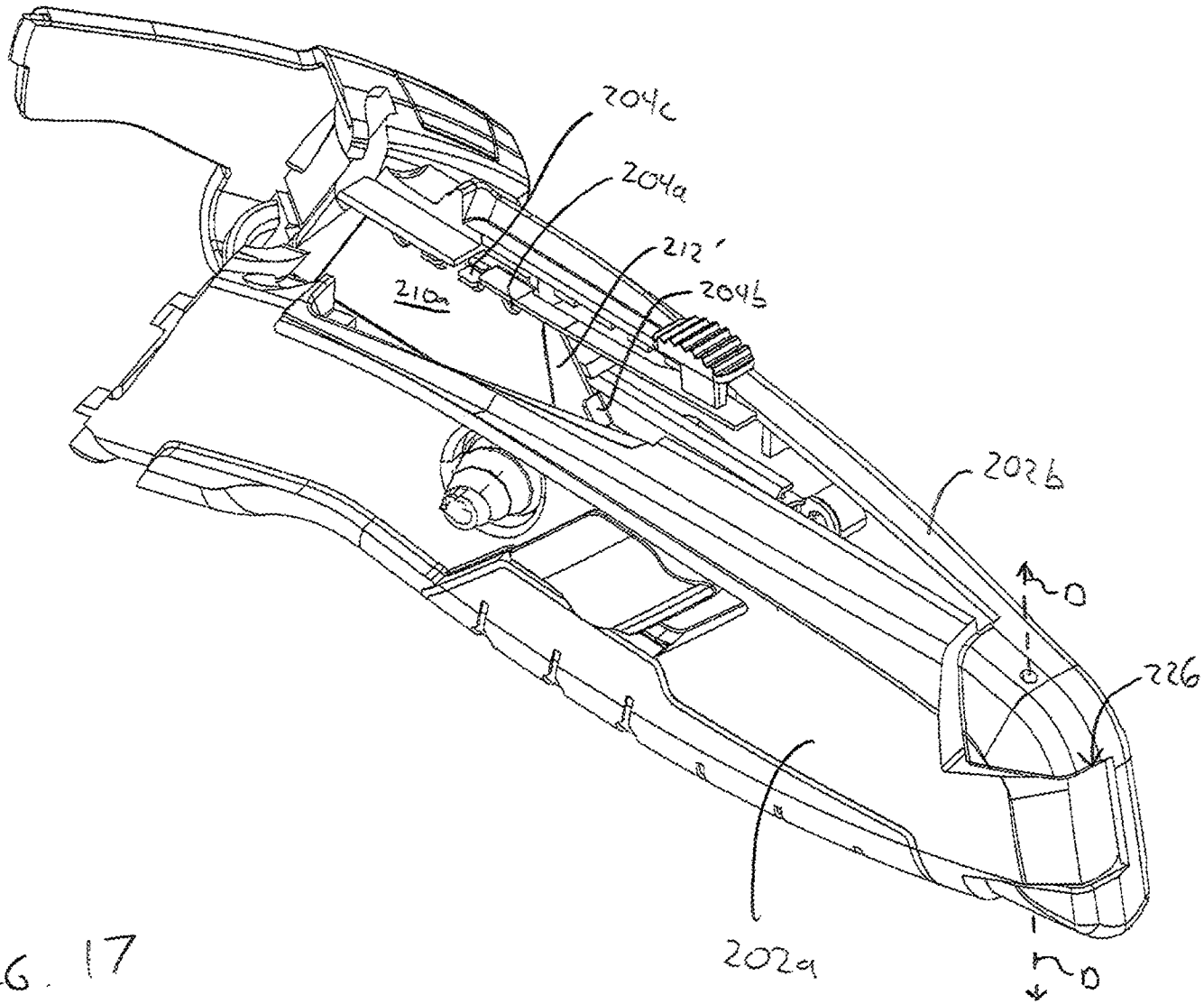
FIG. 17 is a perspective view of the rear left side of the utility knife of FIG. 9, with the blade in a retracted position for storage, the blade snapper mechanism in an opened position facilitating opening of the utility knife for a blade change operation as shown in FIG. 16, and further with a proximal section of the utility knife housing being separated from a distal section of the utility knife housing to facilitate opening the utility knife.
Figure 18:
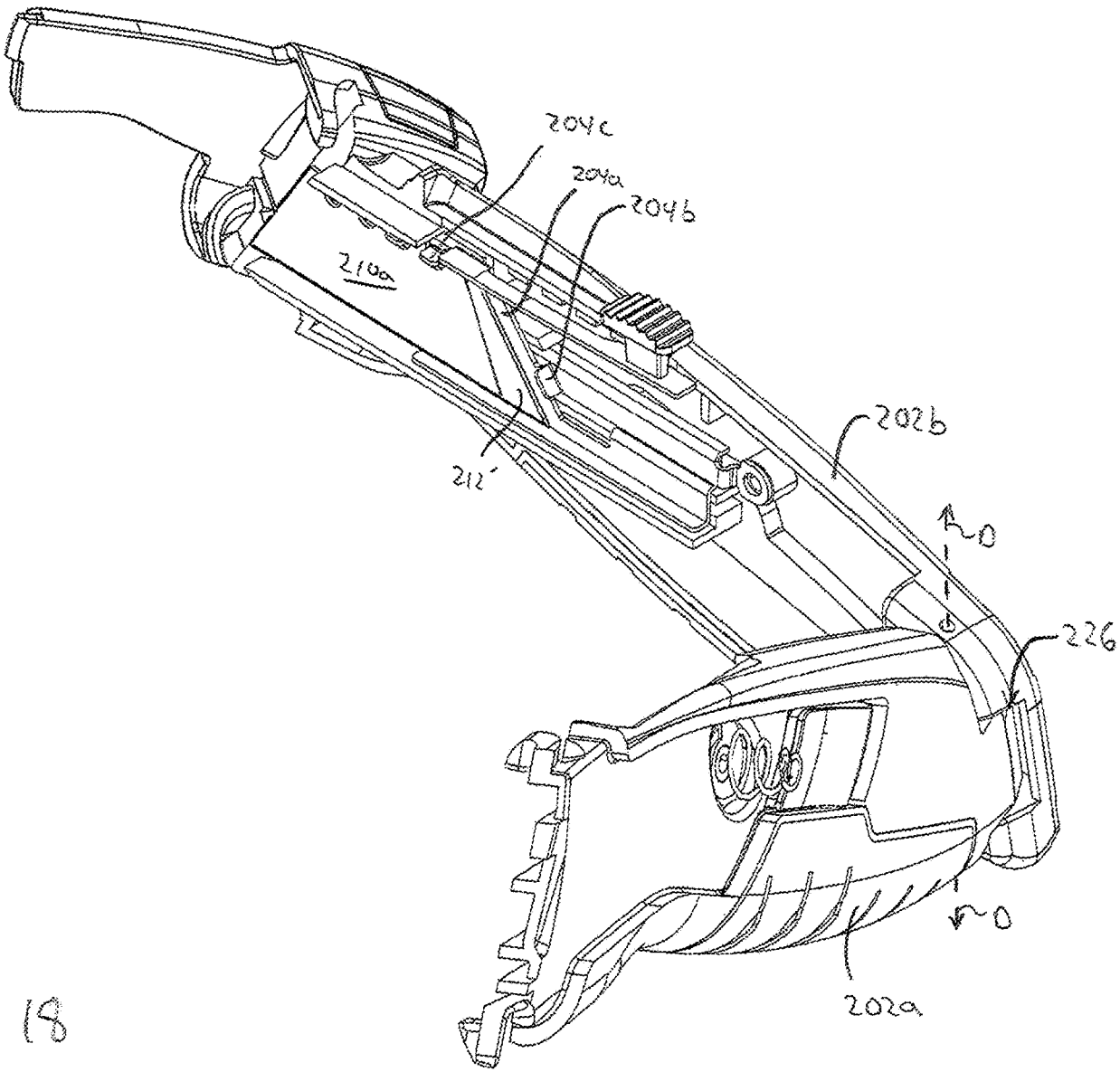
FIG. 18 is a perspective view of the rear left side of the utility knife of FIG. 9, with the blade in a retracted position, the blade snapper mechanism and proximal section of the utility knife housing being opened as shown in FIG. 17, with the proximal section of the utility knife more fully separated from a distal section of the utility knife housing, and further with the utility knife blade having been moved forward so as to better expose a new point created following separation of the detached separable portion of the blade.

FIGS. 16-18 illustrate how in an embodiment the knife 200 may be configured to open fully for removal of the blade 210 from the blade carriage 204*a* of the blade slider 204, such as for rotation of the blade 210 to expose a previously unused side, or replacement with a new blade 210. As shown in FIG. 16, when the blade slider 204 is in a retracted position for storage of a blade 210, the blade snapper 206 may be extended into an opened position through actuation of the blade snapper latch 208 and subsequent pivoting of the blade snapper mechanism about the axis of rotation C described above. It may be appreciated that the blade snapper 206 may be sufficiently rotated such that a first body portion 202*a*, which is hingedly connected to a second body portion 202*b* at a hinge 226 associated with an axis of rotation D. As shown, in some embodiments, the axis of rotation D may be nonparallel to the axis of rotation C. It may further be appreciated from FIG. 16 that in an embodiment, the sufficient rotation of the blade snapper 206 may be such that the arced body 220*a* separates from the arced recess 220*b* of the interlock feature 220. As such, upon such separation, pivotal movement of the first body portion 202*a* relative to the second body portion 202*b* from the hinge 226 may be achieved to open the body 202.

FIG. 17 shows the first body portion 202*a* partially opened relative to the second body portion 202*b*. As shown, the blade 210 is depicted therein in the blade carriage 204*a*.

As further shown, the blade 210 is illustrated in FIG. 17 as though the blade snapping procedure has removed the blade segment 212, yet the blade 210 otherwise remains in its original position, with the opposing blade segment 212' remaining recessed into the back of the blade carriage 204*a*. It may be appreciated that in some embodiments, the as-snapped blade 210 may sufficiently extend forward of the knife 200 for use of the new point defined between the main body 210*a* of the blade 210 and the now removed segment 212. It may be desirable in some embodiments, however, to either move the blade 210 further forward in the blade carriage 204*a*, or rotate the blade so that the segment 212' is exposed for use. As is known from blades of the type of blade 210, in some embodiments multiple notches may be provided in the blade so as to facilitate differing positions of the blade 210 relative to the blade carriage 204*a*. As such, while in FIG. 17 the blade segment 212' is abutting a blade seat 204*b* of the blade slider 204, while a blade engaging protrusion 204*c* of the blade slider 204 is in an interior notch of the main body 210*a*, in FIG. 18 (where the first body portion 202*a* is even further opened from the second body portion 202*b* through rotation at hinge 226), the blade 210 is depicted as having been moved forward in the blade carriage 204*a*. Accordingly, the blade 210 is shown in FIG. 18 with the blade engaging protrusion 204*c* extending into a rear-most notch of the main body 210*a*, moving the blade 210 further forward in the blade carriage 204*a*, such that the segment 212' is spaced forward from the blade seat 204*b*. It may be appreciated that in other uses the blade 210 may be fully removed from the blade carriage 204*a*, and rotated to permit selectively exposing the blade segment 212' for use (and eventual subsequent snapping), or permit further exposing a point between the main body 210*a* of the blade 210 and the segment 212' following snapping of the segment 212' from the main body 210*a*.

Figure 19A:
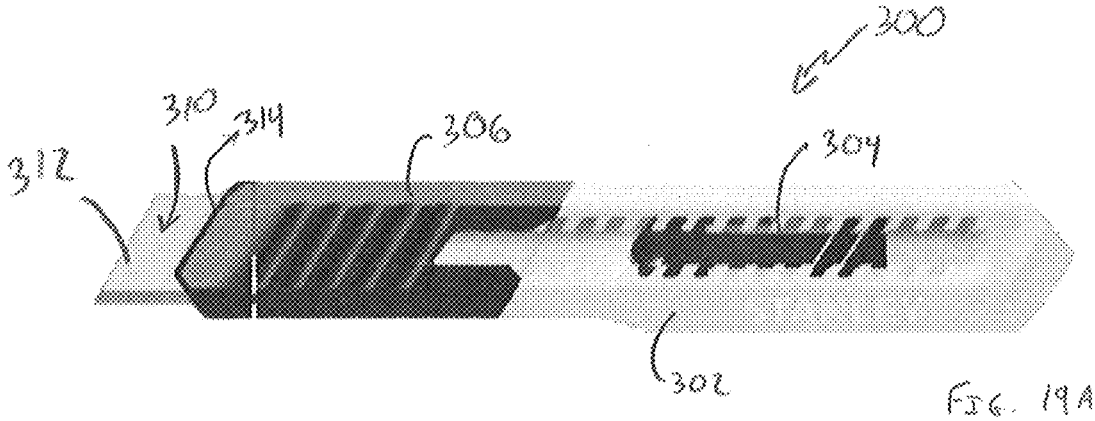
FIGS. 19A-D illustrate an embodiment of a snap-off blade utility knife having an integrated front blade snapper that slides forward relative to the body from a non-pivotable position to a pivotable position whereupon which a blade snapping operation may be initiated.
Figure 19B:
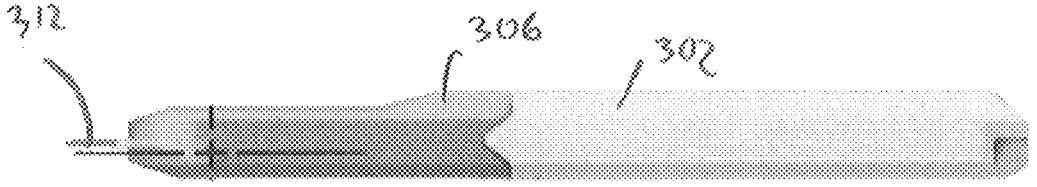
Figure 19C:
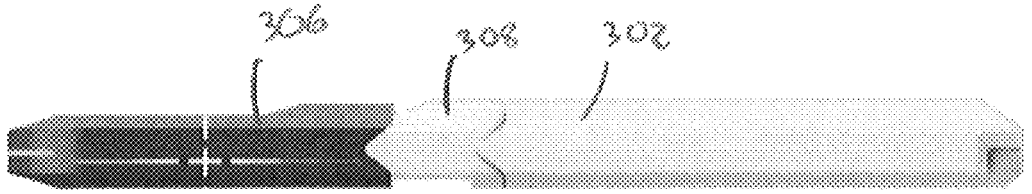
Figure 19D:
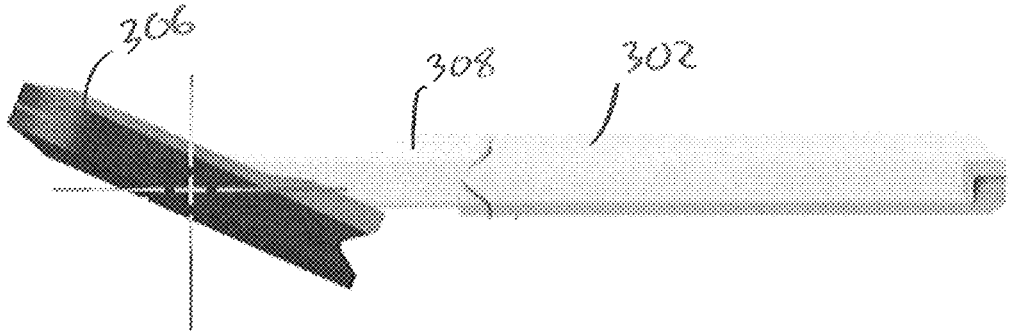

FIGS. 19A-D illustrate a snap-off blade utility knife 300 according to another embodiment of the present invention. As shown, the knife 300 includes a body 302 having a blade slider 304, and a blade snapper 306. As shown, the blade snapper 306 is slidable relative to the body 302, and may telescope over a corresponding surface 308 formed at a front end of the body 302. Such movement is more clearly seen through the forward movement of the blade snapper 306 between the view of FIG. 19B and view of FIG. 19C. As shown in FIG. 19D, once the blade snapper 306 is moved into an extended forward position, telescoping engagement between the blade snapper 306 and the surface 308 may disengage, permitting pivotal movement of the blade snapper 306. It may be appreciated from the disclosure pertaining to the embodiments above that such pivotal movement may exert a blade snapping force on a blade assembly 310 secured to the blade slider 304 and extendable or retractable into the body 302 through actuation of the blade slider 304. It may be appreciated that such a blade snapping force may be sufficient to detach a forwardmost blade segment 312 from the remainder of the blade assembly 310. It may further be appreciated that the blade slider 304 may be configured to extend or retract the blade assembly 310 so that at least the forwardmost blade segment 312 selectively extends through an opening 314 at a forward end of the blade snapper 306. Slidable and (eventual) pivotal movement of the blade snapper 306 may be guided by one or more pins and grooves or channels, correspondingly formed on the interior of the blade snapper 306 and the surface 308, wherein a pin may ride along a channel until engagement features preventing pivotal movement of the blade snapper 306 disengage, permitting a user to pivot the blade snapper 306 such as is shown in FIG. 19D.

Figure 20A:
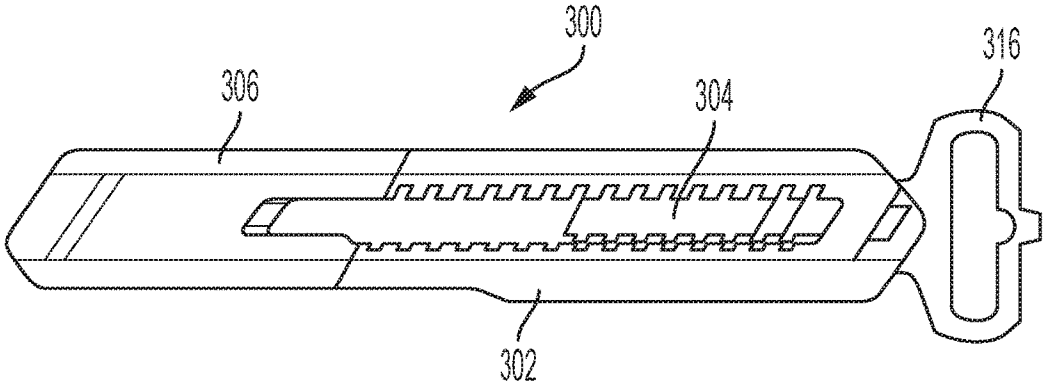
FIGS. 20A-B illustrate the knife of FIGS. 19A-D, with an additional slider lock combined with packaging material for the knife, preventing extension of a blade until the packaging material is removed.
Figure 20B:
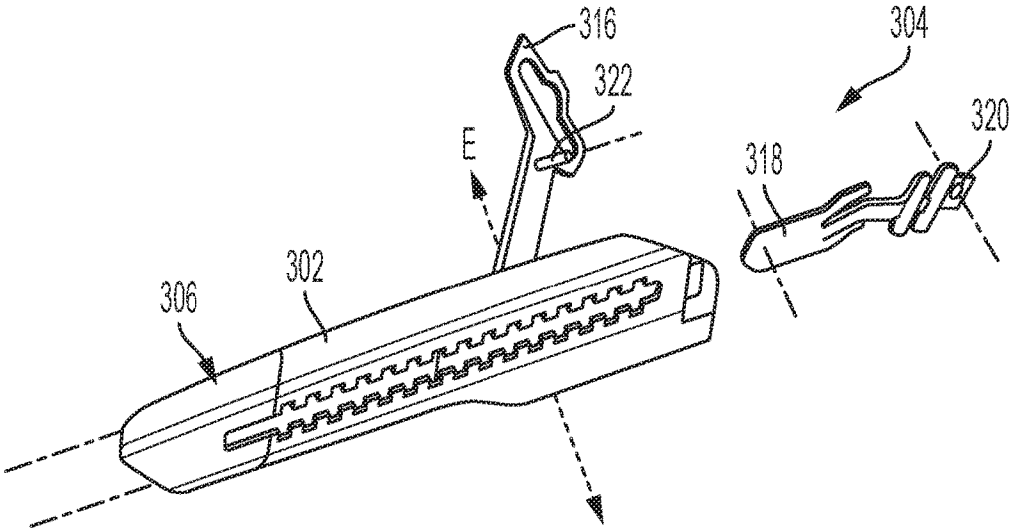

As shown in FIGS. 20A-B, in some embodiments the knife 300 may be configured to include detachable packaging material 316. It may be appreciated as discussed below, that in some embodiments a pivotable blade lock feature may be of a similar configuration. Specifically, as shown in FIG. 20B, in an embodiment the blade slider 304 may include a blade engagement feature 318 configured to hold onto the blade assembly 310, but may also include a packaging material engagement feature 320, such as an aperture, configured to selectively receive a corresponding feature 322 on the packaging material 316. In an embodiment, the packaging material 316 may be coupled to the body 302 through a detachable hinge or perforated member, which may allow the packaging material 316 to pivot at an axis of rotation E. When rotated, the feature 322 may penetrate the feature 320 (e.g., when the blade 310 is in a fully retracted position for storage and/or for point of sale), preventing extension of the blade 310 or slidable movement of the blade slider 304 until the packaging material 316 is pivoted away from the body 302 so that the feature 322 disengages from the feature 320. It may be appreciated that the material 316 may include a hang tag or other point of sale information (marketing and pricing information, for example), while detachment of the material 316 from the body 302 may permit movement of the blade slider 304 as well as permit discarding such materials. In some embodiments, the hinge connecting the feature 322 to the body 302 may be configured for repeated pivoting, and as such may be utilized as part of a blade lock so as to retain the blade slider 304 in a locked position when the slider 304 is appropriately retracted, and the feature 322 is pivoted to engage the feature 320.

Figure 21C:
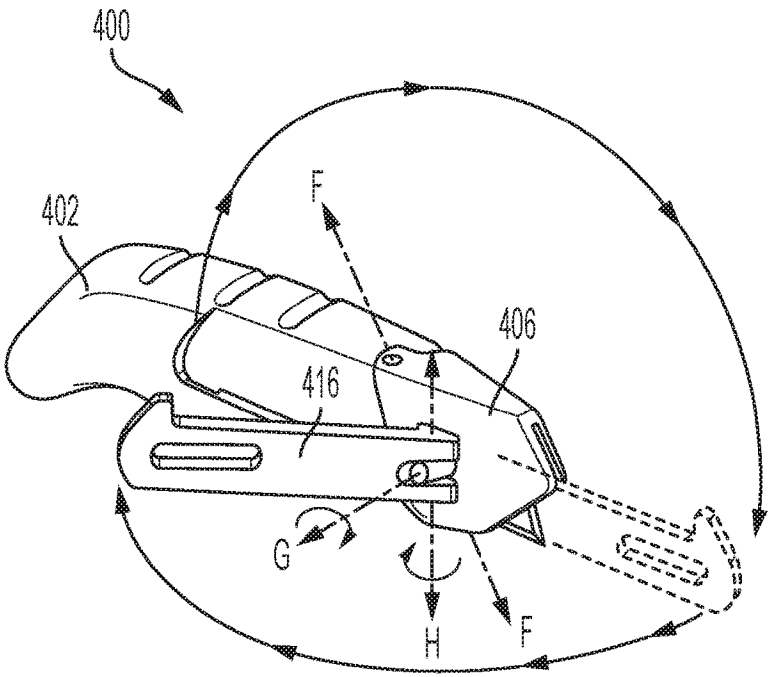
FIGS. 21A-E illustrate an embodiment of a snap-off blade utility knife having a rotatable lever arm that is held flush to a body of the knife until being rotated and pivoted to form a pressable lever to impart additional force to blade snapping operation.
Figure 21A:
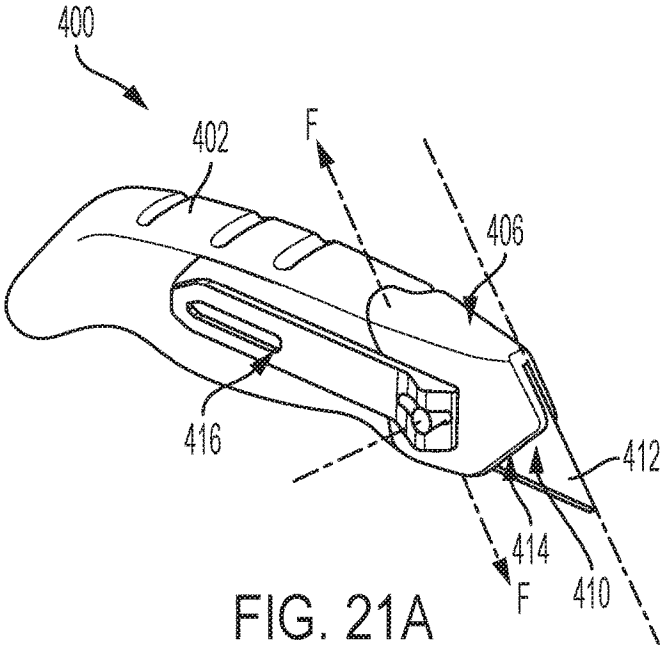
Figure 21B:
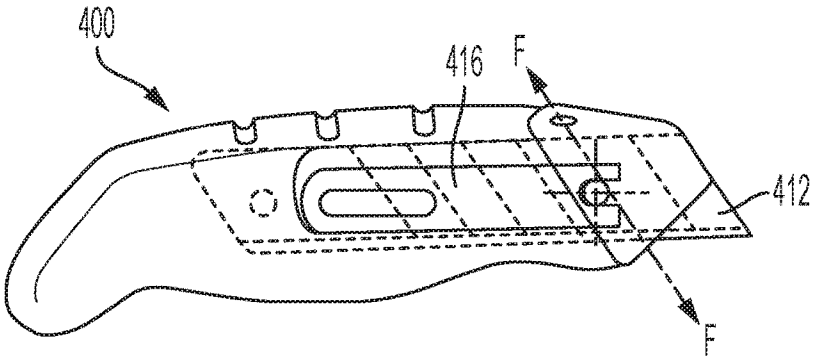
Figure 21D:
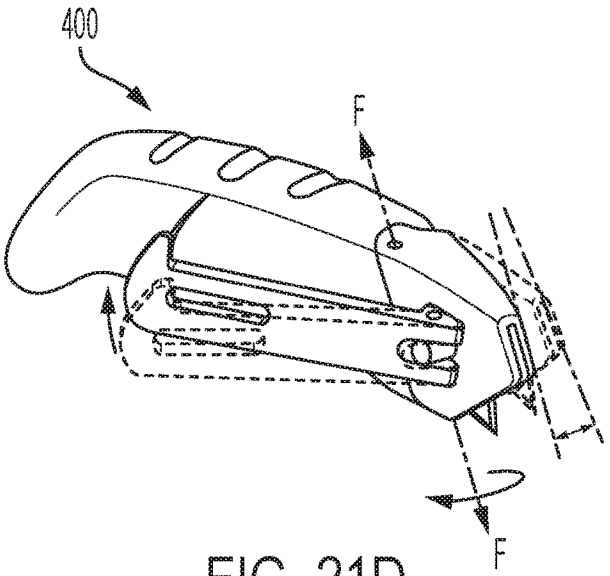
Figure 21E:
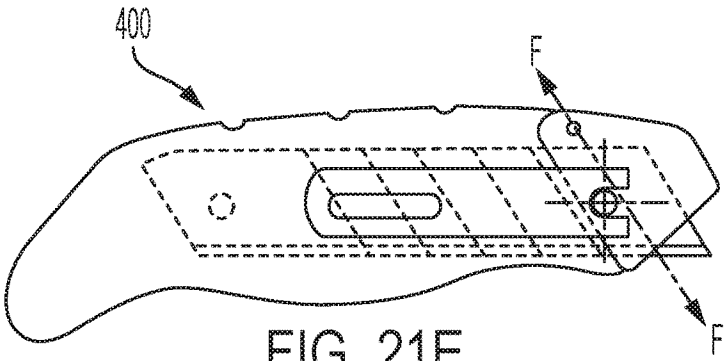

Another embodiment of a snap blade utility knife is shown in FIGS. 21A-E. Specifically, according to an embodiment, a snap-off blade utility knife 400 may include a includes a body 402, a blade slider (obscured), and a blade snapper 406. The retractable blade slider is constructed and arranged to be able to position a multi-blade blade assembly 410 at a position of use wherein at least a portion of a forwardmost blade segment 412 projects through an opening 414 at a forward end of the blade snapper 406 as mounted to the body 402, and to retract the blade assembly 410 into the body 402 so that no blades are exposed outside the body 402. As further shown, the knife 400 includes a rotatable lever arm 416 that may be held flush to the body 402 until being rotated and pivoted, as shown in FIG. 21C, to form a pressable lever to impart additional force to a blade snapping operation such as that described in the embodiments above, which as shown in FIG. 21D would pivot the blade snapper 406 about an axis F so as to exert a blade snapping force on the forwardmost blade segment 412. It may be appreciated that the configuration and structure of the lever arm 416 may be similar to a pair of nail clippers, however may be configured such that pressing the lever arm 416 against the body 402 once rotated and pivoted moves the blade snapper 406 about the axis F rather than closing jaws around the blade segment 412 in some embodiments. Accordingly, with reference to FIG. 21C, in an embodiment actuation of the lever arm 416 may comprise rotation of the lever arm 416 approximately 180° about an axis G to the front of the knife 400, then folding the lever arm 416 by rotating about an axis H which may be generally perpendicular to the axis G, so that pressing the lever arm 416 relative to the body 402 causes pivotal movement of the blade snapper 406 about the axis F.

Figure 22A:
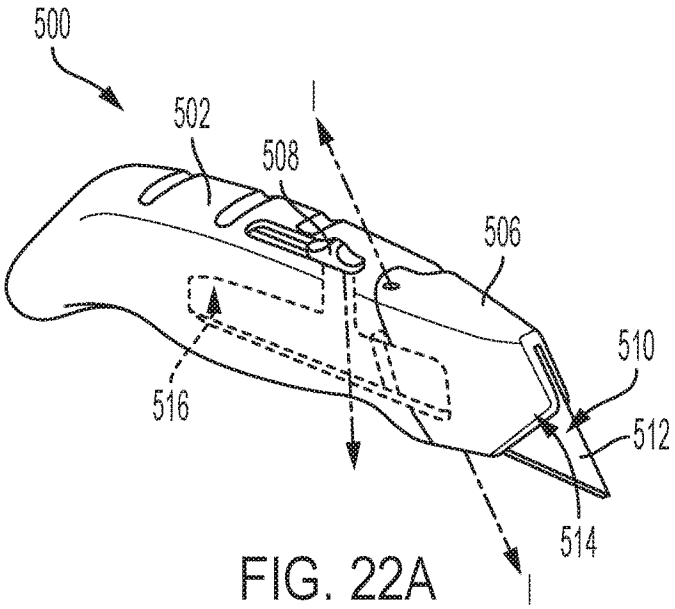
FIGS. 22A-B illustrate an embodiment of a utility knife having a slide lock to selectively release a pivotable blade snapping head to permit a blade snapping operation.
Figure 22B:
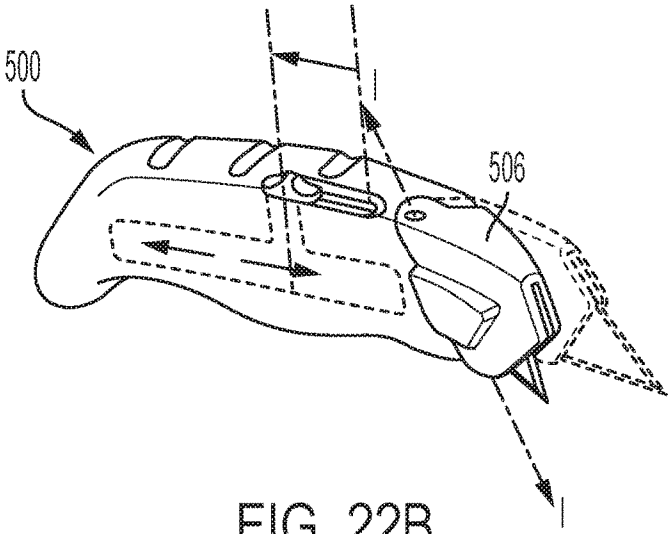

Another embodiment illustrated in FIGS. 22A-B show utility knife 500 of the present invention, which includes a body 502, a blade slider (obscured), a blade snapper 506, and a blade snapper slide latch 508. The retractable blade slider is constructed and arranged to be able to position a multi-blade blade assembly 510 at a position of use wherein at least a portion of a forwardmost blade segment 512 projects through an opening 514 at a forward end of the blade snapper 506 as mounted to the body 502, and to retract the blade assembly 510 into the body 502 so that no blades are exposed outside the body 502. As shown, the latch 508 is coupled to a feature 516 which move in a corresponding channel extending along the body 502 and into the snapper 506. Retraction of the latch 508 moves the features 516 completely into the body 502, so that a user can pivot the blade snapper 506 about an axis I. In some embodiments, the feature 516 may be spring biased into engagement with the blade snapper 506. In some embodiments, the feature may be movable entirely into the snapper 506 rather than entirely into the body 502. Regardless, it may be appreciated that such movement of the latch 508 and corresponding feature 516 may prevent crossing between the body 502 and snapper 506, so that pivotal movement of the snapper 506 relative to the body 502 is not obstructed.

In various embodiments, the knives and blades described herein may be formed of metal, plastic, ceramic, or any other appropriate material. It may be appreciated that the components described herein may be of different constructions or configurations, including but not limited to one or more being comprised of different material choices. For example, the components described herein may each be constructed from a variety of materials, including but not limited to one or more of fabrics, plastics, metals, rubbers, elastomers, or any other appropriate material choice. For example, in an embodiment one or more of the components (e.g., blade assembly 110 or blade 210) may be formed of aluminum (e.g., machined aluminum), iron (e.g., steel), ceramic, or any other appropriate material. Similarly, portions of the knives 100 and 200, including one or more of body 102 or 202 and blade snapper 106 or 206 may be formed from molded plastic, metal, or combinations thereof (e.g., plastic with metal supports or fasteners coupling portions tougher). In some embodiments, structural and functional components may be formed from metal or hard plastic, while gripped components positioned to engage the palm of a gripping hand to provide the palm with a comfortable gripping surface may be made of a suitable molded plastic material or elastomeric material, and may be generally formed as a bi-material suitable molded plastic material coated with a layer of an elastomeric material, such as a rubber based material. In some embodiments, the material choices may differ from component to component. In various embodiments, some components may be integrally formed together, while other components may be assembled by any appropriate mechanism, including but not limited to fastened, welded, snap-fit, friction fit, adhesive bonding, or other appropriate securements.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A knife comprising:

a body;

a blade slider slidably mounted within the body, the blade slider configured to hold and slidably move a blade relative to the body; and a blade snapper pivotally coupled to the body, positioned such that when the blade slider selectively positions the blade to be engaged by the blade snapper, pivotal movement of the blade snapper imparts a force on a blade segment of the blade to detach the blade segment from the blade;

wherein the blade snapper comprises an opening through which the blade selectively extends through movement of the blade slider; and wherein the blade snapper comprises a magnet recessed in the opening for holding a separated blade segment, following separating the blade segment with the blade snapper until removed by a user.

2. The knife of claim 1, wherein the blade snapper comprises a lever arm that extends along the body.

3. The knife of claim 2, wherein the lever arm is flush with the body when the blade snapper is positioned for extension of the blade slider and selective extension of the blade for a cutting operation.

4. The knife of claim 1, further comprising a blade snapper latch configured to selectively hold the blade snapper positioned for extension of the blade slider and selective extension of the blade for a cutting operation.

5. The knife of claim 4, wherein the blade snapper latch has a latch spring biased into a holding position that holds the blade snapper against the body until a user actuates the blade snapper latch by pulling the latch away from the blade snapper against the spring bias of the latch spring.

6. The knife of claim 4, wherein the blade snapper has a snapper spring biased into an actuated position away from a holding position that holds the blade snapper against the body until a user actuates the blade snapper latch.

7. The knife of claim 6, wherein the snapper spring is configured to pivot the blade snapper away from the body to create a user engageable surface so that the user can position their fingernails or fingertips between the blade snapper and the body to initiate desired movement of the blade snapper.

8. The knife of claim 6, wherein the snapper spring is configured to pivot the blade snapper away from the body with an external force to detach the blade segment from the blade.

9. The knife of claim 1, wherein the blade comprises a plurality of snappable blade segments extending from a tang of the blade that couples to the blade slider, the plurality of blade segments extending from the tang such that as a forwardmost-blade segment of the plurality of blade segments is utilized it can be snapped off and discarded to expose a blade segment that is next to the forwardmost-blade segment.

10. The knife of claim 1, wherein:

the blade has a main body with one or more mounting notches formed in a first linear edge and a cutting edge thereof opposite the first linear edge; and the blade has one or more detachable blade segments mounted to the main body.

11. The knife of claim 1, wherein the body comprises a first body portion pivotally coupled to a second body portion at a body hinge, so that the body can be opened by pivoting the first body portion relative to the second body portion at the body hinge.

12. The knife of claim 11, wherein the blade snapper is pivotally coupled to the second body portion at a blade snapper hinge.

13. A knife comprising:

a body;

a blade slider slidably mounted within the body, the blade slider configured to hold and slidably move a blade relative to the body; and a blade snapper pivotally coupled to the body, positioned such that when the blade slider selectively positions the blade to be engaged by the blade snapper, pivotal movement of the blade snapper imparts a force on a blade segment of the blade to detach the blade segment from the blade;

wherein the blade snapper is configured to pivot relative to the body so as to take up a gap behind the blade adjacent to the blade segment so as to support or provide an opposing force to the blade relative to the force being applied by a segment engaging region of the blade snapper to the blade segment.

14. The knife of claim 13, wherein a width of the gap corresponds to a width of a blade carriage portion of the blade slider.

15. A knife comprising:

a body;

a blade slider slidably mounted within the body, the blade slider configured to hold and slidably move a blade relative to the body; and a blade snapper pivotally coupled to the body, positioned such that when the blade slider selectively positions the blade to be engaged by the blade snapper, pivotal movement of the blade snapper imparts a force on a blade segment of the blade to detach the blade segment from the blade; and a blade segment removal tool configured to hold a separated blade segment following separating the blade segment with the blade snapper, the blade segment removal tool being configured to selectively move the blade segment into a position easily removed by a user.

16. The knife of claim 15, wherein the segment removal tool includes a magnet positioned to magnetically attract and hold the separated blade segment.

17. The knife of claim 15, wherein the segment removal tool is detachable from the knife.

18. A knife comprising:

a body;

a blade slider slidably mounted within the body, the blade slider configured to hold and slidably move a blade relative to the body; and a blade snapper pivotally coupled to the body, positioned such that when the blade slider selectively positions the blade to be engaged by the blade snapper, pivotal movement of the blade snapper imparts a force on a blade segment of the blade to detach the blade segment from the blade;

wherein the blade snapper and the body comprise an interlock feature, wherein an arced body on one of the blade snapper and the body is selectively received in an arced recess on the other of the blade snapper and the body through pivotal motion of the blade snapper.

19. The knife of claim 18, wherein the body comprises a first body portion pivotally coupled to a second body portion at a body hinge, so that the body can be opened by pivoting the first body portion relative to the second body portion at the body hinge;

wherein the blade snapper is pivotally coupled to the second body portion at a blade snapper hinge; and wherein pivoting of the blade snapper relative to the body at the blade snapper hinge disengages the arced body from the arced recess, permitting pivotal movement of the first body portion relative to the second body portion at the body hinge.

* * * * *